US009694588B2

(12) United States Patent
Shiota et al.

(10) Patent No.: US 9,694,588 B2
(45) Date of Patent: Jul. 4, 2017

(54) LIQUID SUPPLY UNIT

(71) Applicant: SEIKO EPSON CORPORATION, Tokyo (JP)

(72) Inventors: Takayuki Shiota, Kitakyusyu (JP); Atsushi Kobayashi, Matsumoto (JP); Tadahiro Mizutani, Shiojiri (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/147,101

(22) Filed: May 5, 2016

(65) Prior Publication Data

US 2016/0243842 A1 Aug. 25, 2016

Related U.S. Application Data

(62) Division of application No. 14/573,192, filed on Dec. 17, 2014, now Pat. No. 9,511,594.

(30) Foreign Application Priority Data

Dec. 18, 2013 (JP) ..... 2013-260964
Dec. 26, 2013 (JP) ..... 2013-270007
(Continued)

(51) Int. Cl.
*B41J 2/175* (2006.01)
*B41J 2/17* (2006.01)

(52) U.S. Cl.
CPC ..... *B41J 2/1752* (2013.01); *B41J 2/175* (2013.01); *B41J 2/1714* (2013.01); *B41J 2/1753* (2013.01);
(Continued)

(58) Field of Classification Search
USPC ..... 347/85, 86, 89
See application file for complete search history.

(56) References Cited

U.S. PATENT DOCUMENTS 4,556,012 A 12/1985 Scrudato
5,182,581 A 1/1993 Kashimura et al.
(Continued)

FOREIGN PATENT DOCUMENTS

CN 103204005 A 7/2013
EP 0993954 A2 4/2000
(Continued)

OTHER PUBLICATIONS

Non-Final Office Action issued on Jun. 26, 2015 in U.S. Appl. No. 14/573,424.

*Primary Examiner* — Lam Nguyen
(74) *Attorney, Agent, or Firm* — Stroock & Stroock & Lavan LLP

(57) ABSTRACT

A technique of enhancing attachment of a liquid supply unit to a liquid ejection device is provided. A first cartridge 100*a* and a second cartridge 100*b* are attached to a carriage 27 of a printing device 27 via a holder structure 200. The holder structure 200 has a lever member 230 rotated and moved to engage with a main engagement part 120 of each of the first and the second cartridges 100*a* and 100*b*. Each of the first and the second cartridges 100*a* and 100*b* has a first side wall portion 125 and a second side wall portion 126 configured to press the lever member 230 and rotate and move the lever member 230 forward in the course of attachment of the first or the second cartridge 100*a* or 100*b* to the holder structure 200. A rotation axis RX of the lever member 230 is located at a position closer to an ink supply port 110 or 110*a* than the first side wall portion 125 and the second side wall portion 126 in the course of attachment of the first or the second cartridge 100*a* or 100*b*.

12 Claims, 24 Drawing Sheets

(30) Foreign Application Priority Data

| | | |
|---|---|---|
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(52) U.S. Cl.
CPC ..... *B41J 2/17523* (2013.01); *B41J 2/17526* (2013.01); *B41J 2/17553* (2013.01)

(56) References Cited

U.S. PATENT DOCUMENTS

| | | | |
|---|---|---|---|
| 5,488,401 | A | 1/1996 | Mochizuki et al. |
| 5,552,861 | A | 9/1996 | Mizude et al. |
| 5,619,239 | A | 4/1997 | Kotaki et al. |
| 6,000,789 | A | 12/1999 | Takagi et al. |
| 6,033,064 | A | 3/2000 | Pawlowski, Jr. et al. |
| 6,152,555 | A | 11/2000 | Nozawa et al. |
| 6,170,941 | B1 | 1/2001 | Hara et al. |
| 6,250,750 | B1 | 6/2001 | Miyazawa et al. |
| 6,276,780 | B1 | 8/2001 | Carrese et al. |
| 6,302,530 | B1 | 10/2001 | Shimada et al. |
| 6,302,535 | B1 | 10/2001 | Sturgeon et al. |
| 6,375,315 | B1 | 4/2002 | Steinmetz et al. |
| 6,416,152 | B1 | 7/2002 | Matsuzaki et al. |
| 6,431,697 | B1 | 8/2002 | King et al. |
| 6,439,491 | B1 | 8/2002 | Liao |
| 6,488,369 | B1 | 12/2002 | Steinmetz et al. |
| 6,502,917 | B1 | 1/2003 | Shinada et al. |
| 6,739,708 | B2 | 5/2004 | Studer et al. |
| 6,776,479 | B2 | 8/2004 | Ardito et al. |
| 6,899,417 | B1 | 5/2005 | Shinada et al. |
| 7,066,587 | B2 | 6/2006 | Andersen et al. |
| 7,178,909 | B2 | 2/2007 | Yoshiyama et al. |
| 7,213,914 | B2 * | 5/2007 | Anma ..... B41J 2/17546 347/86 |
| 7,258,431 | B2 | 8/2007 | Shinada et al. |
| 7,300,142 | B1 | 11/2007 | Usui et al. |
| 7,445,320 | B2 | 11/2008 | Jung et al. |
| RE41,601 | E | 8/2010 | Matsuzaki et al. |
| 8,297,738 | B1 | 10/2012 | Kodama et al. |
| 8,297,739 | B1 | 10/2012 | Kodama et al. |
| 8,439,482 | B1 | 5/2013 | Kodama et al. |
| 8,540,347 | B2 | 9/2013 | Ishizawa et al. |
| 2001/0045977 | A1 | 11/2001 | King et al. |
| 2002/0085075 | A1 | 7/2002 | Shinada et al. |
| 2002/0118262 | A1 | 8/2002 | Seino et al. |
| 2002/0158948 | A1 | 10/2002 | Miyazawa et al. |
| 2002/0167574 | A1 | 11/2002 | Shinada et al. |
| 2002/0171700 | A1 | 11/2002 | Shinada et al. |
| 2002/0171701 | A1 | 11/2002 | Shinada et al. |
| 2002/0175977 | A1 | 11/2002 | Hanson et al. |
| 2002/0180823 | A1 | 12/2002 | Shinada et al. |
| 2003/0058296 | A1 | 3/2003 | Shinada et al. |
| 2003/0081088 | A1 | 5/2003 | King et al. |
| 2003/0085969 | A1 | 5/2003 | Shinada et al. |
| 2004/0246304 | A1 | 12/2004 | Takahashi et al. |
| 2004/0246317 | A1 | 12/2004 | Hayashi et al. |
| 2005/0146576 | A1 | 7/2005 | Shinada et al. |
| 2005/0168549 | A1 | 8/2005 | Shinada et al. |
| 2005/0195255 | A1 | 9/2005 | Shinada et al. |
| 2006/0033790 | A1 | 2/2006 | Shinada et al. |
| 2006/0066696 | A1 | 3/2006 | Matsumoto et al. |
| 2006/0119677 | A1 | 6/2006 | Shinada et al. |
| 2006/0203050 | A1 | 9/2006 | Shinada et al. |
| 2006/0290757 | A1 | 12/2006 | Shinada et al. |
| 2007/0247501 | A1 | 10/2007 | Shinada et al. |
| 2008/0049080 | A1 | 2/2008 | Hayashi et al. |
| 2008/0049081 | A1 | 2/2008 | Hayashi et al. |
| 2008/0284830 | A1 | 11/2008 | Shinada et al. |
| 2009/0009560 | A1 | 1/2009 | Shinada et al. |
| 2009/0027453 | A1 | 1/2009 | Shinada et al. |
| 2009/0040274 | A1 | 2/2009 | Shinada et al. |
| 2009/0040275 | A1 | 2/2009 | Shinada et al. |
| 2011/0273520 | A1 | 11/2011 | Shinada et al. |
| 2013/0182046 | A1 | 7/2013 | Kodama et al. |
| 2013/0182047 | A1 | 7/2013 | Nozawa et al. |
| 2013/0182048 | A1 | 7/2013 | Nozawa et al. |
| 2013/0182049 | A1 | 7/2013 | Kodama et al. |
| 2013/0182052 | A1 | 7/2013 | Matsuzaki et al. |
| 2013/0182053 | A1 | 7/2013 | Kodama et al. |
| 2014/0152746 | A1 | 6/2014 | Kodama et al. |
| 2014/0210917 | A1 | 7/2014 | Kodama et al. |
| 2014/0368585 | A1 | 12/2014 | Nozawa et al. |
| 2015/0077486 | A1 | 3/2015 | Kodama et al. |
| 2016/0129696 | A1 | 5/2016 | Nozawa et al. |
| 2016/0375688 | A1 | 12/2016 | Kodama et al. |

FOREIGN PATENT DOCUMENTS

| | | | |
|---|---|---|---|
| JP | 07-148936 | A | 6/1995 |
| JP | 09-011500 | A | 1/1997 |
| JP | 10-016249 | A | 1/1998 |
| JP | 10-235890 | A | 9/1998 |
| JP | 10-278290 | A | 10/1998 |
| JP | 10-286972 | A | 10/1998 |
| JP | 2000-033707 | A | 2/2000 |
| JP | 2000-190522 | A | 7/2000 |
| JP | 2001-121715 | A | 5/2001 |
| JP | 2001-253087 | A | 9/2001 |
| JP | 2001-277534 | A | 10/2001 |
| JP | 3248831 | B | 11/2001 |
| JP | 2002-292905 | A | 10/2002 |
| JP | 2003-072099 | A | 3/2003 |
| JP | 2003-520713 | A | 7/2003 |
| JP | 2004209662 | A | 7/2004 |
| JP | 2004-230704 | A | 8/2004 |
| JP | 2004-358914 | A | 12/2004 |
| JP | 2005-028883 | A | 2/2005 |
| JP | 2005-125559 | A | 5/2005 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2008-074090 | A | 4/2008 |
| JP | 2008-074100 | A | 4/2008 |
| JP | 2008279783 | A | 11/2008 |
| JP | 2013-141804 | A | 7/2013 |
| JP | 2013-158980 | A | 8/2013 |

* cited by examiner

CROSS SECTIONAL VIEW TAKEN ON LINE A-A IN FIG. 4

LIQUID SUPPLY UNIT

CROSS-REFERENCE TO RELATED APPLICATIONS

This application is a divisional application of U.S. patent application Ser. No. 14/573,192, filed on Dec. 17, 2014, which claims priority to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-018365 filed on Feb. 3, 2014, JP 2014-029769 filed on Feb. 19, 2014, JP 2014-031192 filed on Feb. 21, 2014, JP 2014-034847 filed on Feb. 26, 2014, JP 2014-037928 filed on Feb. 28, 2014, JP 2014-037929 filed on Feb. 28, 2014, JP 2014-045198 filed on Mar. 7, 2014, JP 2014-057360 filed on Mar. 20, 2014, JP 2014-061295 filed on Mar. 25, 2014, JP 2014-061296 filed on Mar. 25, 2014, JP 2014-061297 filed on Mar. 25, 2014, and JP 2014-118344 filed on Jun. 9, 2014, entire disclosures of which are incorporated herein by reference for all purposes.

BACKGROUND

Technical Field

The present invention relates to a liquid supply unit configured to supply a liquid to a liquid ejection device.

Description of the Related Art

A known liquid supply unit is, for example, an ink cartridge configured to supply ink to an inkjet printer. The inkjet printer (hereinafter simply called "printer") is one type of a liquid ejection device and is provided as a printing device to eject ink droplets on a printing surface and thereby form an image. The ink cartridge is attachable to and detachable from a carriage included in the printer via a mounting mechanism. According to a technique disclosed in JP 2013-141804A, the ink cartridge is attached to the carriage by rotating operation of a lever.

SUMMARY

In order to enhance the attachment of the ink cartridge to the carriage, there is a need to readily determine the angle and the moving direction of the ink cartridge in the course of attachment to the carriage and stabilize the locus of the ink cartridge. There is also a need to reduce the external force applied by the user to the ink cartridge for attachment. Additionally, there is a need to enhance the fixation and the stability of the ink cartridge after attachment.

Some type of ink cartridge has a circuit substrate for transmission of electric signals to and from the printer. The printer to which this type of ink cartridge is attached detects the state of attachment of the ink cartridge to the carriage and obtains information regarding ink contained in the ink cartridge through transmission of signals via this circuit substrate. It is desirable to attach this type of ink cartridge to the printer, in order to ensure the electrical connectivity with the printer.

Further improvement in attachment of the ink cartridge has been demanded, and various studies and works have been performed. Other needs with regard to the ink cartridge include improvement of the space use efficiency by downsizing, cost reduction, easy manufacture, resource saving and improvement of usability. These problems are not limited to the ink cartridge attached to the printer but are commonly found in any of various liquid supply units which are attached to and connected with a device consuming a liquid, such as a liquid ejection device ejecting a liquid, so as to supply the liquid to the liquid-consuming device.

In order to solve at least part of the problems described above, the invention may be implemented by aspects described below.

[1] According to one aspect of the invention, there is provided a liquid supply unit attachable to a liquid ejection device having a liquid introduction conduit and a rotating mechanism including a first pressed part and a second pressed part. The liquid supply unit may comprise a liquid supply port, a first pressure element and a second pressure element. The liquid supply port may be formed to supply a liquid into the liquid introduction conduit configured to introduce the liquid into the liquid ejection device. The first pressure element may be configured to press the first pressed part. The second pressure element may be configured to press the second pressed part. In the course of attachment of the liquid supply unit to the liquid ejection device, the first pressure element and the second pressure element press the rotating mechanism so as to rotate the first pressed part and the second pressed part in a direction away from the liquid supply unit in such a state that a distance between the liquid supply port and the first pressure element and a distance between the liquid supply port and the second pressure element in a connecting direction of moving the liquid supply port toward the liquid introduction conduit are longer than a distance in the connecting direction between the liquid supply port and a supporting point of rotation of the rotating mechanism. The liquid supply unit of this aspect is attached to the liquid ejection device in the state that the rotating mechanism is pressed at the two points of the first pressure element and the second pressure element. This stabilizes the attitude of the liquid supply unit during attachment. Placing the pressure elements away from the supporting point of the rotating mechanism reduces the force of rotating the rotating mechanism and facilitates attachment of the liquid supply unit. This accordingly improves the attachment of the liquid supply unit.

[2] The liquid supply unit of the above aspect may further comprise an abutting part configured to come into contact with the rotating mechanism when the liquid supply unit is attached to the liquid ejection device. The first pressure element and the second pressure element may be configured to release pressing against the first pressed part and the second pressed part in a state that the abutting part is in contact with the rotating mechanism. The configuration of the liquid supply unit of this aspect facilitates the attachment operation of the liquid supply unit.

[3] The liquid supply unit of the above aspect may further comprise a plurality of contact portions arrayed in an array direction to be electrically connectable with an electrode assembly of the liquid ejection device. The plurality of contact portions may include a first contact portion and a second contact portion located on both ends in the array direction. A distance between the first pressure element and the second pressure element in the array direction may be greater than a distance between the first contact portion and the second contact portion in the array direction. The configuration of the liquid supply unit of this aspect enhances the electrical connectivity with the liquid ejection device.

[4] The liquid supply unit of the above aspect may further comprise a first detection terminal and a second detection terminal used by the liquid ejection device to detect attachment of the liquid supply unit. The first detection terminal may have the first contact portion, and the second detection terminal may have the second contact portion. The configuration of the liquid supply unit of this aspect improves the detection accuracy of the state of attachment of the liquid supply unit to the liquid ejection device.

[5] The liquid supply unit of the above aspect may further comprise: a storage unit; a data terminal configured to have a third contact portion which is electrically connectable with the liquid ejection device, located between the first detection terminal and the second detection terminal in the array direction, and provided to supply data to the storage unit; a high potential terminal configured to have a fourth contact portion which is electrically connectable with the liquid ejection device, located between the first detection terminal and the second detection terminal in the array direction, and provided to supply a high potential to the storage unit; and a low potential terminal configured to have a fifth contact portion which is electrically connectable with the liquid ejection device, located between the first detection terminal and the second detection terminal in the array direction, and provided to supply a low potential to the storage unit. The configuration of the liquid supply unit of this aspect enhances the connectivity of the respective terminals and thereby improves the communication quality between the storage unit of the liquid supply unit and the liquid ejection device.

[6] The liquid supply unit of the above aspect may further comprise a wall surface where the first pressure element, the second pressure element, the first contact portion and the second contact portion are placed. The first pressure element may be more protruded from the wall surface than the first contact portion. In the liquid supply unit of this aspect, the first contact portion is protected by the first pressure element. Accordingly this configuration reduces a potential failure of electrical connection with the liquid ejection device due to deterioration of the first contact portion.

[7] The liquid supply unit of the above aspect may further comprise an abutting part configured to come into contact with the rotating mechanism when the liquid supply unit is attached to the liquid ejection device. The abutting part may be placed on the wall surface. The configuration of the liquid supply unit of this aspect facilitates the attachment operation of the liquid supply unit.

[8] The liquid supply unit of the above aspect may further comprise an intersecting wall surface constructed to intersect with the wall surface. The abutting part may be formed by an extended section extended from the intersecting wall surface toward the wall surface. The configuration of the liquid supply unit of this aspect enhances the attachment of the liquid supply unit.

[9] The liquid supply unit of the above aspect may further comprise: a first wall; a second wall opposed to the first wall; a third wall constructed to intersect with the first wall and the second wall; a fourth wall constructed to intersect with the first wall and the second wall and opposed to the third wall; a fifth wall constructed to intersect with the first wall, the second wall, the third wall and the fourth wall; and a sixth wall constructed to intersect with the first wall, the second wall, the third wall and the fourth wall and opposed to the fifth wall. The wall surface may be a wall surface of the fourth wall. In a plan view of the liquid supply unit in a direction from the fourth wall toward the third wall, a distance from the fifth wall to the first pressure element may be shorter than a distance from the fifth wall to the first contact portion, and a distance from the sixth wall to the second pressure element may be shorter than a distance from the sixth wall to the second contact portion. In the liquid supply unit of this aspect, the first contact portion and the second contact portion are located in an area between the two pressure elements in a direction from the fifth wall toward the sixth wall. Accordingly this enhances the electrical connectivity with the liquid ejection device.

[10] In the liquid supply unit of the above aspect, in a plan view of the liquid supply unit in a direction from the fourth wall toward the third wall, the first contact portion and the second contact portion may be located between the first pressure element and the second pressure element. The configuration of the liquid supply unit of this aspect suppresses the array direction of the first contact portion and the second contact portion from being inclined in the course of attachment of the liquid supply unit to the liquid ejection device. Accordingly this enhances the electrical connectivity with the liquid ejection device.

[11] In the liquid supply unit of the above aspect, the first wall may have the liquid supply port. In a plan view of the liquid supply unit in a direction from the first wall toward the second wall, a distance from a center of the liquid supply port to the first pressure element may be longer than a distance from the center of the liquid supply port to the first contact portion. The configuration of the liquid supply unit of this aspect enhances the connectivity of the liquid supply port with the liquid ejection device.

[12] In the liquid supply unit of the above aspect, the center of the liquid supply port may be located between the first contact portion and the second contact portion in a direction from the fifth wall toward the sixth wall. The configuration of the liquid supply unit of this aspect enhances the connectivity of the first contact portion and the second contact portion, as well as the connectivity of the liquid supply port.

[13] The liquid supply unit of the above aspect may be configured to be rotated about a place where the third wall abuts against the liquid ejection device as a supported point and thereby to be attached to the liquid ejection device. The configuration of the liquid supply unit of this aspect stabilizes the locus of attachment to the liquid ejection device and enhances the attachment of the liquid supply unit.

All the plurality of components included in each of the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described later to provide still another independent aspect of the invention.

The invention is applicable to any of various aspects other than the liquid supply unit, for example, a device equipped with the liquid supply unit, a system including such a device, an attachment mechanism, an attachment structure or an attachment method of the liquid supply unit.

DESCRIPTION OF EMBODIMENTS

A. First Embodiment

[Configuration of Printing Device]

Figure 1:
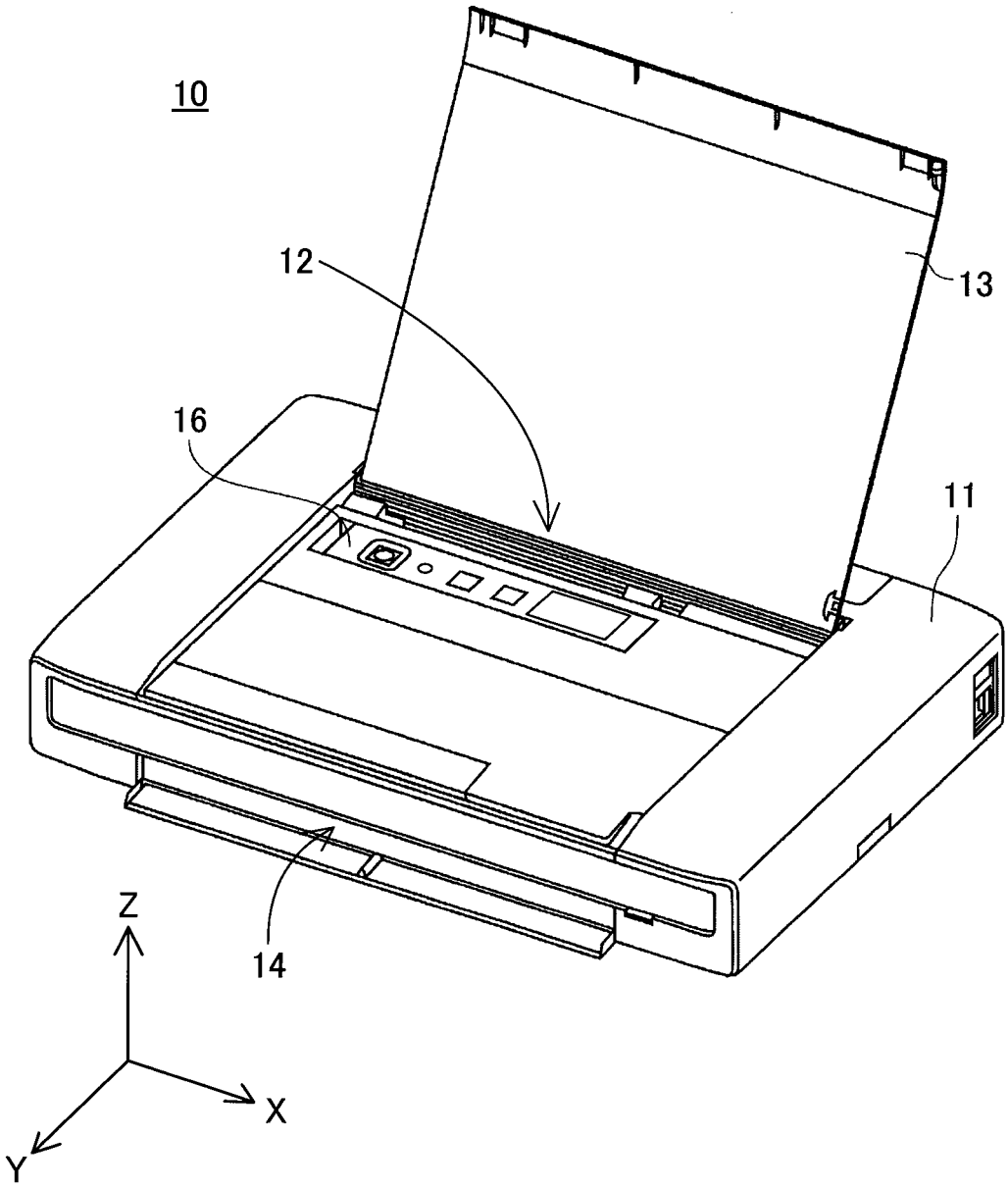
FIG. 1 is a schematic perspective view illustrating the appearance configuration of a printing device.

FIG. 1 is a schematic perspective view illustrating the appearance configuration of a printing device 10 which an ink cartridge (hereinafter may be simply called "cartridge") according to a first embodiment of the invention is attached to. Arrows X, Y and Z representing three different directions orthogonal to one another are illustrated in FIG. 1. The arrow X denotes a direction parallel to a lateral direction (width direction) of the printing device 10 and shows a direction from left to right in the state facing the printing device 10. The arrow Y denotes a direction parallel to a front-back direction of the printing device 10 and shows a direction from backside (rear side) toward foreside (front side). The arrow Z denotes a height direction of the printing device 10 and shows a vertically upward direction relative to a mounting surface where the printing device 10 is placed. In other drawings used for the description herein, the arrows X, Y and Z corresponding to those of FIG. 1 are illustrated as needed basis. In the description herein, "upper" or "up" and "lower" or "down" imply directions on the basis of the direction of the arrow Z of the printing device 10. Similarly, "front" and "back" or "rear" imply directions on the basis of the direction of the arrow Y of the printing device 10, and "left" and "right" imply directions respectively on the basis of the direction of the arrow X of the printing device 10.

The printing device 10 is an inkjet printer as one aspect of a liquid ejection device. The printing device 10 forms an image by ejection of ink droplets on printing paper according to externally supplied print data. The printing device 10 includes a casing 11, a paper feed slot 12, an upper surface cover 13, a paper output slot 14 and an operation unit 16. The casing 11 is an exterior member configured to receive a main unit (described later) with a printing mechanism of the printing device 10 placed therein. The paper feed slot 12 is an opening provided on a rear side of the casing 11 to be open upward. The printing paper as a printing medium is fed through the paper feed slot 12 to the main unit inside of the casing 11.

The upper surface cover 13 is a plate member located near the paper feed slot 12 and mounted on the casing 11 to be rotatable. The upper surface cover 13 serves as a guide plate to guide the printing paper into the paper feed slot 12 in the open state (illustrated state) and serves as a cover member to cover and protect the center area of the upper surface of the casing 11 in the closed state. The paper output slot 14 is an opening provided on the front surface of the casing 11. The printing paper fed through the paper feed slot 12 into the casing 11 is discharged to outside via the paper output slot 14. The operation unit 16 has buttons configured to be operable by the user and a display configured to display information to the user. The operation unit 16 is provided on the upper surface of the casing 11. The operation unit 16 is accessible by the user when the upper surface cover 13 is in the open state.

Figure 2:
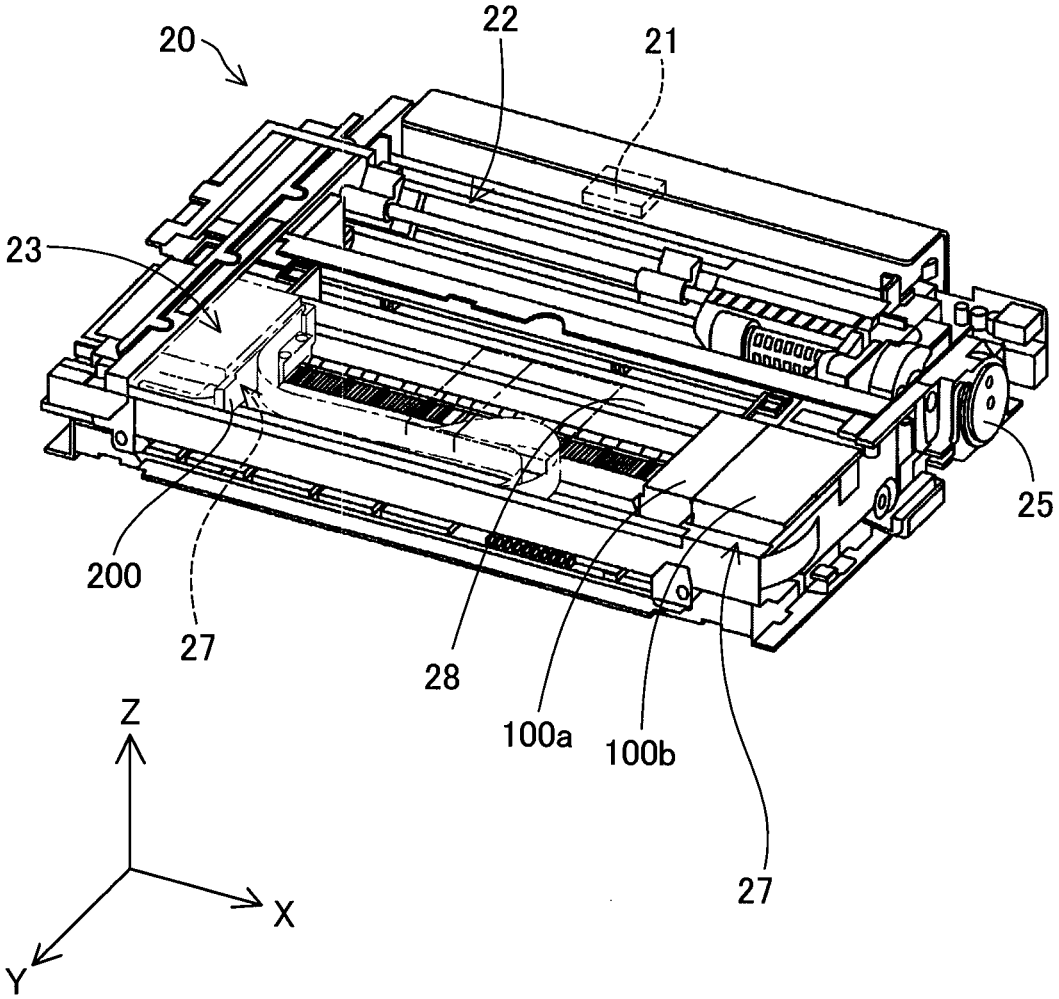
FIG. 2 is a schematic perspective view illustrating the appearance configuration of a main unit of the printing device.

FIG. 2 is a schematic perspective view illustrating the appearance configuration of a main unit 20 taken out of the casing 11 of the printing device 10. The locus of the move of the carriage 27 is schematically illustrated by the broken line in FIG. 2. The main unit 20 includes a controller 21, a conveyance mechanism 22 and a printing unit 23. The controller 21 is made by a microcomputer including a central processing unit and a main storage unit. The controller 21 controls the respective components of the printing device 10 in response to the user's operation of the operation unit 16 or instructions from an external computer to perform a printing operation. The conveyance mechanism 22 conveys the printing paper introduced through the paper feed slot 12 shown in FIG. 1 to the paper output slot 14 by rotating and driving a feed roller 25 via a conveyance path (not shown in figures) extended in the direction of the arrow Y (sub-scan direction) inside of the main unit 20.

The printing unit 23 is located on the conveyance path of the printing paper and performs printing on the printing paper conveyed by the conveyance mechanism 22. The printing unit 23 has a carriage 27 and a guide rail 28. The carriage 27 has a print head (not shown in figures) configured to eject ink droplets. While the carriage 27 moves back and forth along the guide rail 28 extended in a main scan direction (direction of the arrow X) under control of the controller 21, the carriage 27 ejects ink droplets onto the sheet surface of the printing paper conveyed in the sub-scan direction by the conveyance mechanism 22. The printing device 10 of the embodiment is an on-carriage type and has two cartridges 100*a* and 100*b* detachably attached to the carriage 27 via a holder structure 200.

Figure 3:
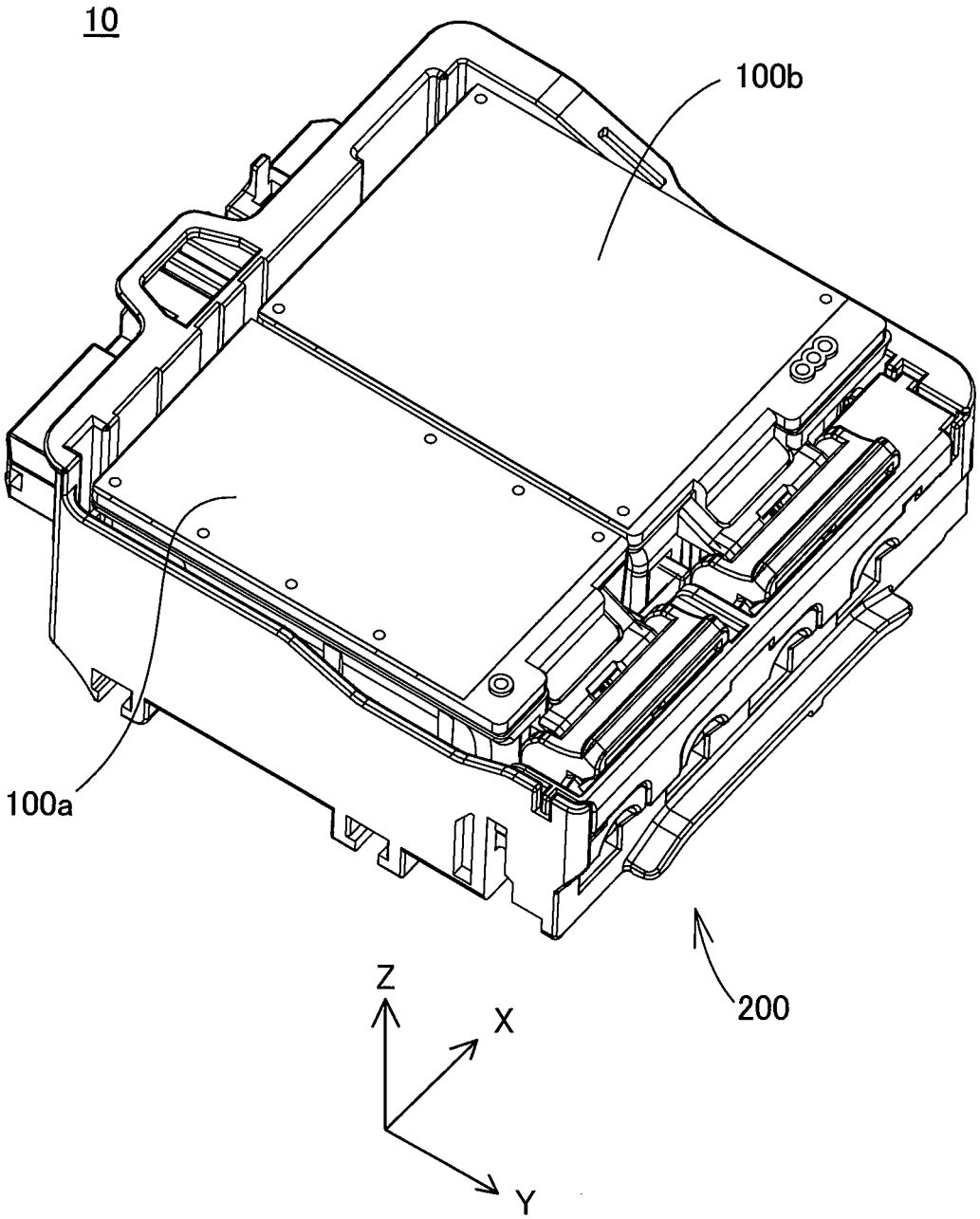
FIG. 3 is a schematic perspective view illustrating first and second cartridges attached to a holder structure.

FIG. 3 is a schematic perspective view illustrating the first cartridge 100*a* and the second cartridge 100*b* attached to the holder structure 200 in the printing device 10. The first cartridge 100*a* and the second cartridge 100*b* correspond to the liquid supply unit and are respectively configured to contain ink to be supplied to the printing device 10. The first cartridge 100*a* is configured to contain a single type of color ink, and the second cartridge 100*b* is configured to contain a plurality of different types of color inks. According to this embodiment, the first cartridge 100*a* contains black color ink, and the second cartridge 100*b* contains cyan, yellow and magenta color inks.

Each of the first and the second cartridges 100*a* and 100*b* is formed in an approximately rectangular parallelepiped shape. The first cartridge 100*a* has length (length in the direction of the arrow Y) and height (length in the direction of the arrow Z) substantially similar to those of the second cartridge 100*b*. The holder structure 200 is provided as an approximately rectangular parallelepiped box-like member having an upper opening. The first and the second cartridges 100*a* and 100*b* are placed in parallel in the inner space of the holder structure 200 in the state that their lengths and heights are substantially the same. In the state attached to the holder structure 200, the first and the second cartridges 100*a* and 100*b* have their side surfaces and bottom surfaces substantially covered and their upper surfaces entirely exposed upward.

The first and the second cartridges 100*a* and 100*b* are fixed to the holder structure 200 independently from each other. The following describes the detailed structures of the first and the second cartridges 100*a* and 100*b* and the detailed configuration of the holder structure 200 and subsequently describes the mechanism of attachment and fixation of the first and the second cartridges 100*a* and 100*b* to the holder structure 200. The directions of the arrows X, Y and Z shown in the drawings illustrating the first and the second cartridges 100*a* and 100*b* denote the directions in the state attached to the printing device 10 described above.

[Structure of First Cartridge]

Figure 4:
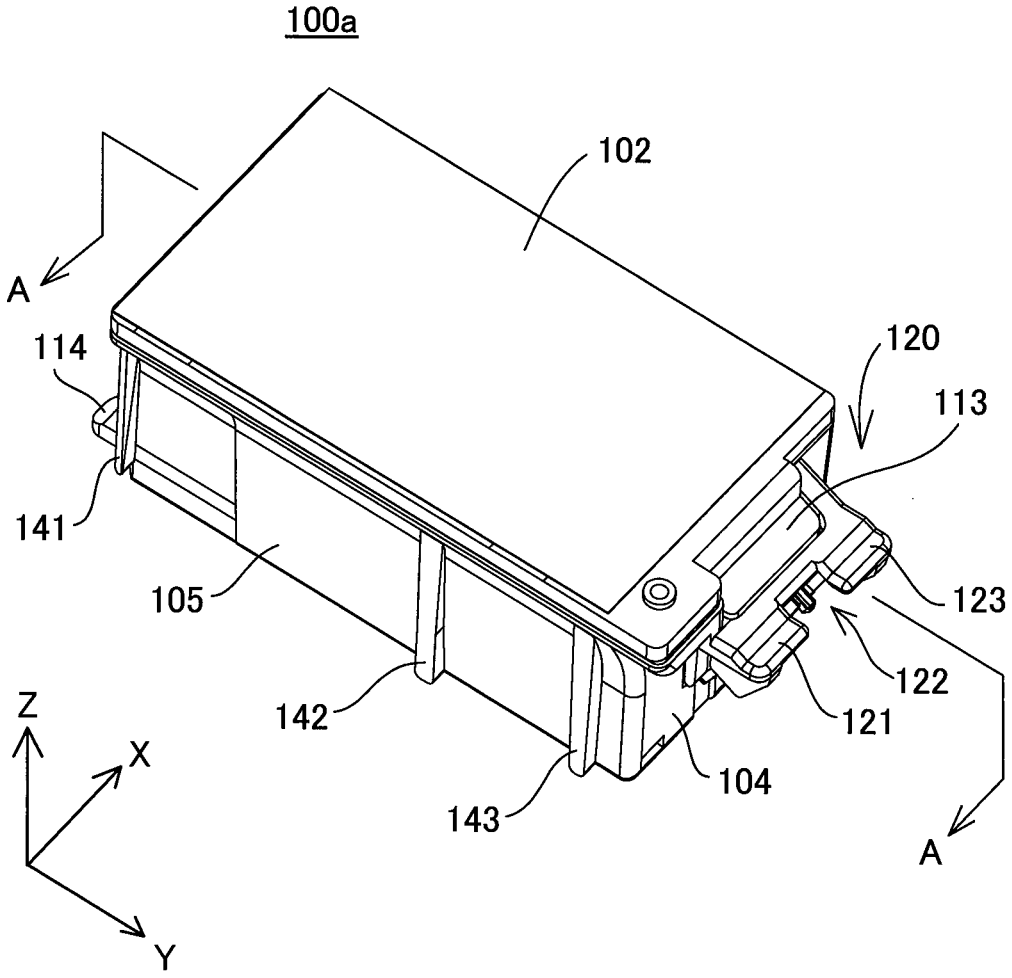
FIG. 4 is a perspective top view illustrating the appearance configuration of the first cartridge.
Figure 5:
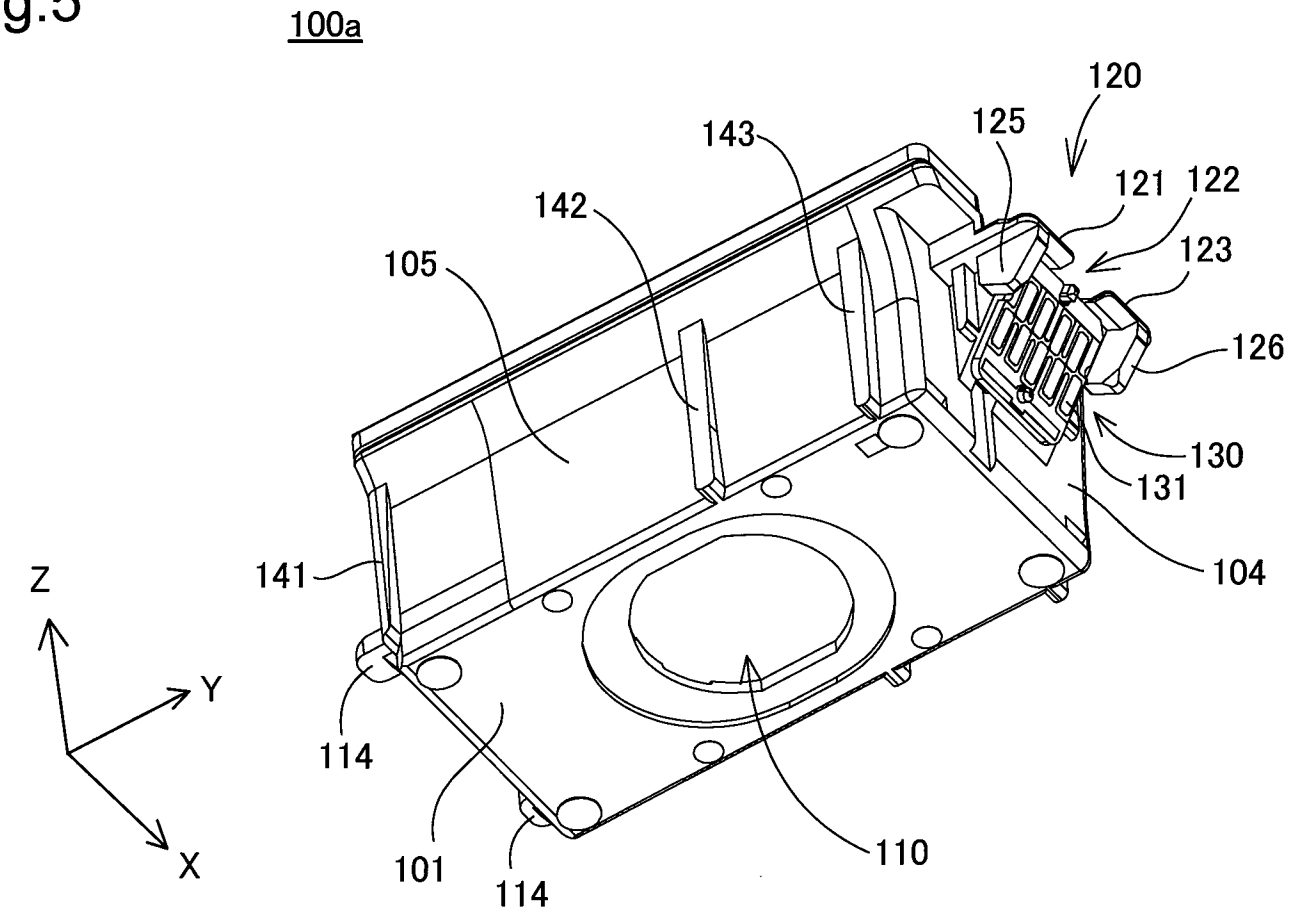
FIG. 5 is a perspective bottom view illustrating the appearance configuration of the first cartridge.
Figure 6:
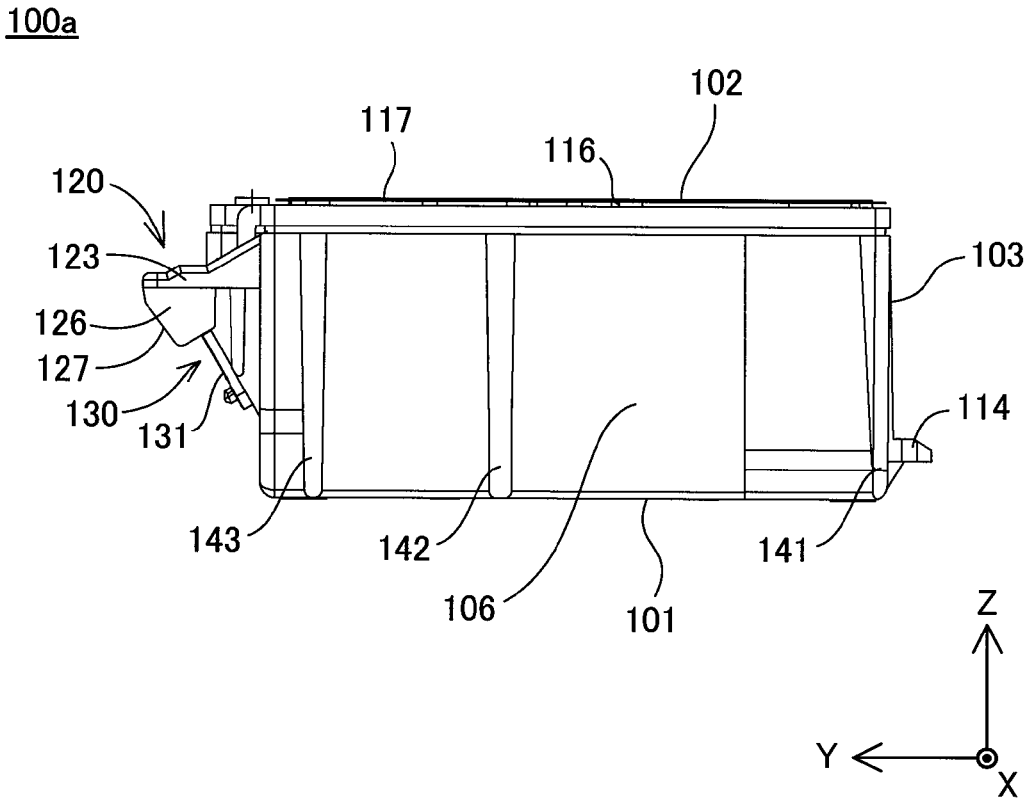
FIG. 6 is a side view illustrating the appearance configuration of the first cartridge.
Figure 7:
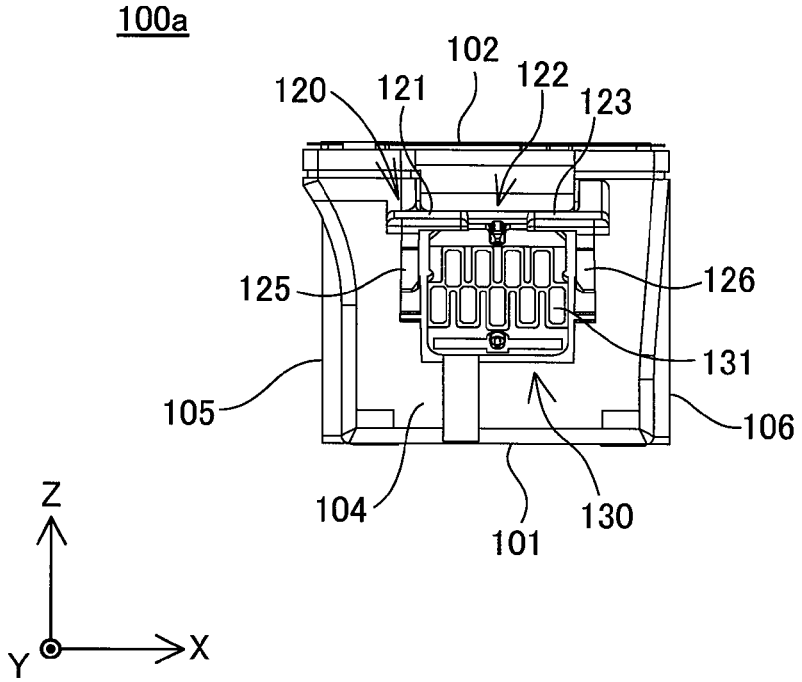
FIG. 7 is a front view illustrating the appearance configuration of the first cartridge.
Figure 8:
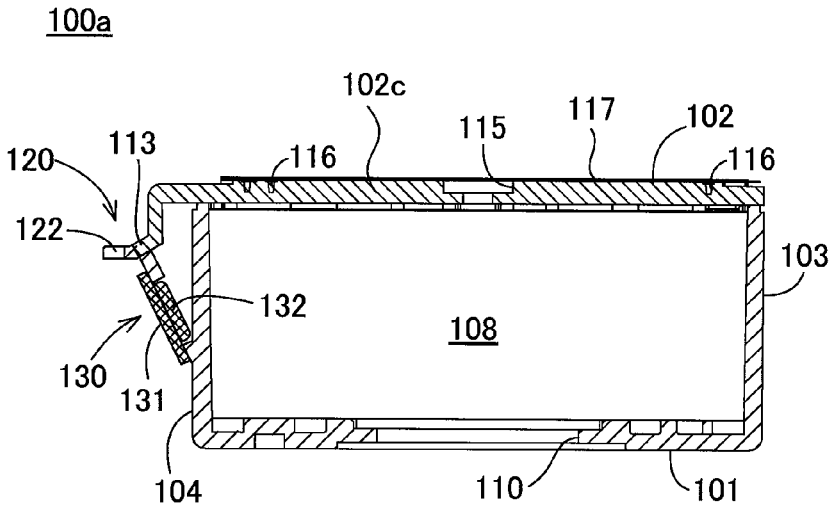
FIG. 8 is a schematic cross sectional view illustrating the first cartridge.
Figure 8:
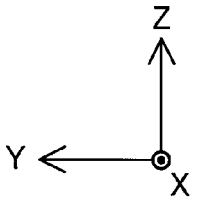

The detailed structure of the first cartridge 100*a* is described with reference to FIGS. 4 to 8. FIG. 4 is a perspective top view illustrating the first cartridge 100*a*. FIG. 5 is a perspective bottom view illustrating the first cartridge 100*a*. FIG. 6 is a side view illustrating the first cartridge 100*a*. FIG. 7 is a front view illustrating the first cartridge 100*a*. FIG. 8 is a schematic cross sectional view illustrating the first cartridge 100*a*, taken on a line A-A in FIG. 4. The detailed internal structure of an ink chamber 108 is omitted from the illustration of FIG. 8.

The first cartridge 100*a* is formed in an approximately rectangular parallelepiped shape as described above and has six walls 101 to 106 arranged to surround an ink chamber 108 shown in FIG. 8 configured to contain ink. The first wall 101 shown in FIG. 5 forms a bottom surface of the first cartridge 100*a*. The bottom surface herein denotes a surface facing in a direction opposite to the direction of the arrow Z in the state of attachment of the first cartridge 100*a* to the printing device 10. An ink supply port 110 communicating with the ink chamber 108 is provided on the center of the first wall 101. The ink supply port 110 is connected with an ink receiving part (described later) of the holder structure 200 in the state of attachment of the first cartridge 100*a* to the holder structure 200. The ink supply port 110 corresponds to the liquid supply port.

The second wall 102 shown in FIG. 4 is opposed to the first wall 101 and forms a top surface of the first cartridge 100*a*. The top surface herein denotes a surface facing in the direction of the arrow Z in the state of attachment of the first cartridge 100*a* to the printing device 10. The second wall 102 is formed by a cover member 102*c* shown in FIG. 8 configured to be separable from the main body of the first cartridge 100*a*.

The second wall 102 has an extended section 113 located on the center of an edge adjacent to the fourth wall 104 to be extended in the direction of the arrow Y. In the description herein, the term "extending" means continuously extending without intermission. The extended section 113 forms part of a main engagement part 120. The second wall 102 also has a through hole 115 through which the ink chamber 108 is filled with ink, an air flow groove 116 arranged to introduce the outside air into the ink chamber 108 and a film-like seal member 117 placed to seal the through hole 115 and the air flow groove 116 shown in FIG. 8.

The third wall 103 shown in FIG. 6 is arranged to intersect with the first wall 101 and the second wall 102. The third wall 103 forms a rear surface of the first cartridge 100*a* and is arranged to face backward of the printing device 10 (direction opposite to the direction of the arrow Y) in the state of attachment of the first cartridge 100*a* to the holder structure 200. The third wall 103 has a plurality of projections 114 at its lower end to be protruded in the direction of the arrow Y. The plurality of projections 114 are placed at both ends in the direction of the arrow X. The plurality of projections 114 are inserted in and engaged with fitting holes (described later) of the holder structure 200 in the course of attachment of the first cartridge 100*a* to the holder structure 200.

The fourth wall 104 is arranged to intersect with the first wall 101 and the second wall 102 and to be opposed to the third wall 103 shown in FIGS. 4 to 8. The fourth wall 104 forms a front surface of the first cartridge 100*a* and is arranged to face forward of the printing device 10 (direction of the arrow Y) and face the user in the state of attachment of the first cartridge 100*a* to the holder structure 200. The fourth wall 104 has the main engagement part 120 which is to be engaged with a lever member (described later) of the holder structure 200. In the description hereof, the term "engaging" means that engaging at a predetermined location to limit the moving direction. The main engagement part 120 is located at a position closer to the upper edge on the fourth wall 104 and is arranged on the approximate center in the direction of the arrow X.

The main engagement part 120 is formed as a tongue-shaped brim extended forward and slightly downward from the second wall 102. The main engagement part 120 has a cut 122 on the center of its front edge as a local recess, such that the front edge of the main engagement part 120 is divided into two separate parts by the recessed space of the cut 122. In other words, the front edge of the main engagement part 120 is configured to have a first brim section 121 as a first section, the cut 122, a second brim section 123 as a second section arranged sequentially in the direction of the arrow X. The first brim section 121 and the second brim section 123 respectively correspond to the abutting part and have respective upper surfaces to come into surface contact with the lever member of the holder structure 200 in the course of engagement with the lever member of the holder structure 200.

A first side wall portion 125 and a second side wall portion 126 are provided on the respective lower surfaces of the first brim section 121 and the second brim section 123. The first side wall portion 125 and the second side wall portion 126 are plate-like members arrayed in the direction of the arrow X. The first side wall portion 125 and the second side wall portion 126 are respectively located at positions away from the wall surface of the fourth wall 104 in the direction of the arrow Y and are provided to be suspended downward from the first brim section 121 and the second brim section 123 and to be protruded from the wall surface of the fourth wall 104. Respective front end faces 127 of the first side wall portion 125 and the second side wall portion 126 are arranged as planar surfaces inclined to the wall surface of the fourth wall 104.

The first side wall portion 125 and the second side wall portion 126 respectively serve as a first pressure element and a second pressure element to press the lever member as the rotating mechanism of the holder structure 200 in the course of attachment of the first cartridge 100*a* to the holder structure 200. The description of this function is described later in detail. The first side wall portion 125 and the second side wall portion 126 also serve as protective elements of a circuit substrate 130 described below.

The circuit substrate 130 is placed below the main engagement part 120 on the fourth wall 104 to transmit electrical signals to and from the printing device 10 shown in FIG. 5. The circuit substrate 130 is fixed to the fourth wall 104 to face its surface slightly downward at an inclination angle of, for example, 10 to 45 degrees relative to the direction of the arrow Z.

The circuit substrate 130 includes a terminal assembly 131 and a storage unit 132 shown in FIG. 8. The terminal assembly 131 is provided on the surface of the circuit substrate 130 and has a plurality of terminals arrayed in a specified array direction. In the state that the first cartridge 100*a* is attached to the holder structure 200, each of the terminals on the terminal assembly 131 comes into contact with and is electrically connected with corresponding one terminal (described later) of a plurality of terminals provided on the holder structure 200. The array configuration of the plurality of terminals included in the terminal assembly 131 of the circuit substrate 130 will be described later. The storage unit 132 is made by, for example, a rewritable nonvolatile memory, such as flash ROM. The storage unit 132 stores information regarding ink, for example, the color and the remaining quantity of ink contained in the first cartridge 100*a* in non-transitory manner.

The printing device 10 detects attachment of the first cartridge 100*a* by causing each of some terminals of the terminal assembly 131 of the circuit substrate 130 to come into contact with and to be electrically connected with corresponding one terminal of the plurality of terminals provided on the holder structure 200. The printing device 10 also obtains the information regarding the ink from the storage unit 132 of the circuit substrate 130.

According to this embodiment, the circuit substrate 130 is located between the first side wall portion 125 and the second side wall portion 126 of the main engagement part 120 shown in FIGS. 5 and 7. The first side wall portion 125 and the second side wall portion 126 are protruded forward from the surface of the circuit substrate 130 on both sides of the circuit substrate 130. Protrusion of the first side wall portion 125 and the second side wall portion 126 on both sides of the circuit substrate 130 suppresses the user from accidentally touching the terminals on the circuit substrate 130 and thereby protects the terminals of the terminal assembly 131.

The fifth wall 105 and the sixth wall 106 are arranged to intersect with the first wall 101, the second wall 102, the third wall 103 and the fourth wall 104 and to be opposed to each other shown in FIGS. 4 to 7. The fifth wall 105 and the sixth wall 106 form side surfaces of the first cartridge 100*a*. Each of the fifth wall 105 and the sixth wall 106 has ribs 141, 142 and 143 on its surface to be extended in the direction of the arrow Z. The first rib 141 is provided on a rear end of the side surface, the second rib 142 is provided at a middle position in the front-back direction of the side surface, and the third rib 143 is provided on a front end of the side surface.

The respective ribs 141, 142 and 143 work as reinforcing elements for the side wall surfaces of the first cartridge 100*a*. In the course of attachment of the first cartridge 100*a* to the holder structure 200, the ribs 141, 142 and 143 serve as guide elements to define the moving direction of the first cartridge 100*a* and as positioning elements to fix the position of the first cartridge 100*a*. Description of these function of the ribs 141, 142 and 143 is described later in detail.

Figure 9:
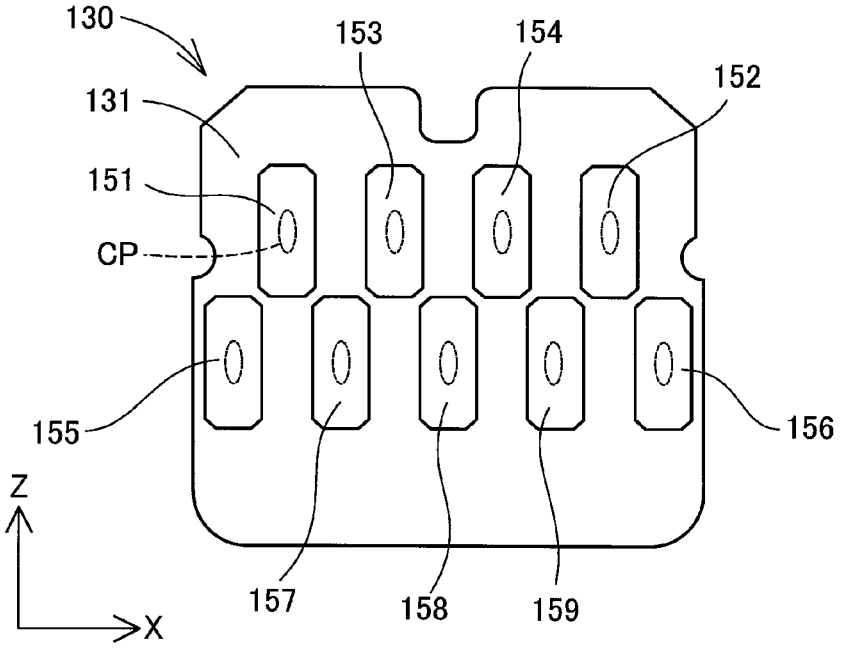
FIG. 9 is a schematic diagram illustrating an array configuration of a plurality of terminals on a circuit substrate.

FIG. 9 is a schematic diagram illustrating an array configuration of a plurality of terminals 151 to 159 on the circuit substrate 130. The positions of contact portions CP of the respective terminals 151 to 159 are shown by broken lines in FIG. 9. Each of the plurality of terminals 151 to 159 has a contact portion CP. Each of the contact portions CP of the respective terminals 151 to 159 comes into contact with and is electrically connected with corresponding one of the terminals (described later) provided on the holder structure 200. The contact portions CP of the plurality of terminals 151 to 159 are arrayed in two lines, i.e., an upper line and a lower line, on the circuit substrate 130 and are arranged in an array direction parallel to the direction of the arrow X (hereinafter this array direction is called "terminal array direction"). The contact portions CP of the first and the second terminals 151 and 152 are located on the respective ends in the upper line. The contact portions CP of the third and the fourth terminals 153 and 154 are aligned in the direction of the arrow X between the contact portions CP of the first terminal 151 and the second terminal 152. The contact portions CP of the fifth and the sixth terminals 155 and 156 are located on the respective ends in the lower line. The contact portions CP of the seventh, the eighth and the ninth terminals 157, 158 and 159 are aligned in the direction of the arrow X between the contact portion CP of the fifth terminal 155 and the sixth terminal 156.

The first terminal 151 and the second terminal 152 respectively correspond to the first detection terminal having the first contact portion and the second detection terminal having the second contact portion and are used by the printing device 10 to detect attachment of the first cartridge 100*a* to the holder structure 200. The first terminal 151 and the second terminal 152 are configured to have a specified voltage change when the first cartridge 100*a* is adequately attached to the holder structure 200 to bring the first terminal 151 and the second terminal 152 into contact with corresponding terminals of the holder structure 200. More specifically, the first terminal 151 and the second terminal 152 are short-circuited from each other and are arranged such that the second terminal 152 has a voltage change based on the voltage applied to the first terminal 151 when the first cartridge 100*a* is attached to the holder structure 200.

In the circuit substrate 130 of this embodiment, the contact portions CP of the first and the second terminals 151 and 152 are placed on the respective ends in the array direction having the less number of the contact portions CP of adjacent terminals. This arrangement suppresses the occurrence of a short circuit with the contact portion CP of another terminal. The contact portions CP of the first and the second terminals 151 and 152 are arranged to be away from each other in the direction of the arrow X. This arrangement suppresses misdetection of attachment of the first cartridge 100*a* inclined to the direction of the arrow X as the correct attachment state. As described above, the circuit substrate 130 of the embodiment is configured to enhance the detection accuracy of the attachment state of the first cartridge 100*a* to the holder structure 200. Specific areas of the first and the second terminals 151 and 152 which come into contact with the corresponding terminals 251 of the device-side terminal assembly 251 correspond to the first contact portion and the second contact portion.

The third terminal 153 is a ground terminal which is grounded when the contact portion CP of the third terminal 153 comes into contact with a corresponding terminal of the holder structure 200 and corresponds to a low potential terminal configured to supply a low potential to the storage unit 132. The fourth terminal 154 is a power terminal which a high potential is applied to when the contact portion CP of the fourth terminal 154 comes into contact with a corresponding terminal of the holder structure 200 and corresponds to a high potential terminal configured to supply a high potential to the storage unit 132.

Like the first and the second terminals 151 and 152, the fifth terminal 155 and the sixth terminal 156 are used by the printing device 10 to detect attachment of the first cartridge 100*a* to the holder structure 200. The seventh terminal 157 is a reset terminal configured to supply a reset signal from the printing device 10 to the storage unit 132. The eighth terminal 158 is a clock terminal configured to supply a clock signal from the printing device 10 to the storage unit 132. The ninth terminal 159 is a data terminal configured to send and receive a data signal between the storage unit 132 and the printing device 10. According to this embodiment, the printing device 10 sends and receives data to and from the storage unit 132 by serial transfer via the ninth terminal 159, in response to the clock signal supplied via the eighth terminal 158.

[Structure of Second Cartridge]

Figure 10:
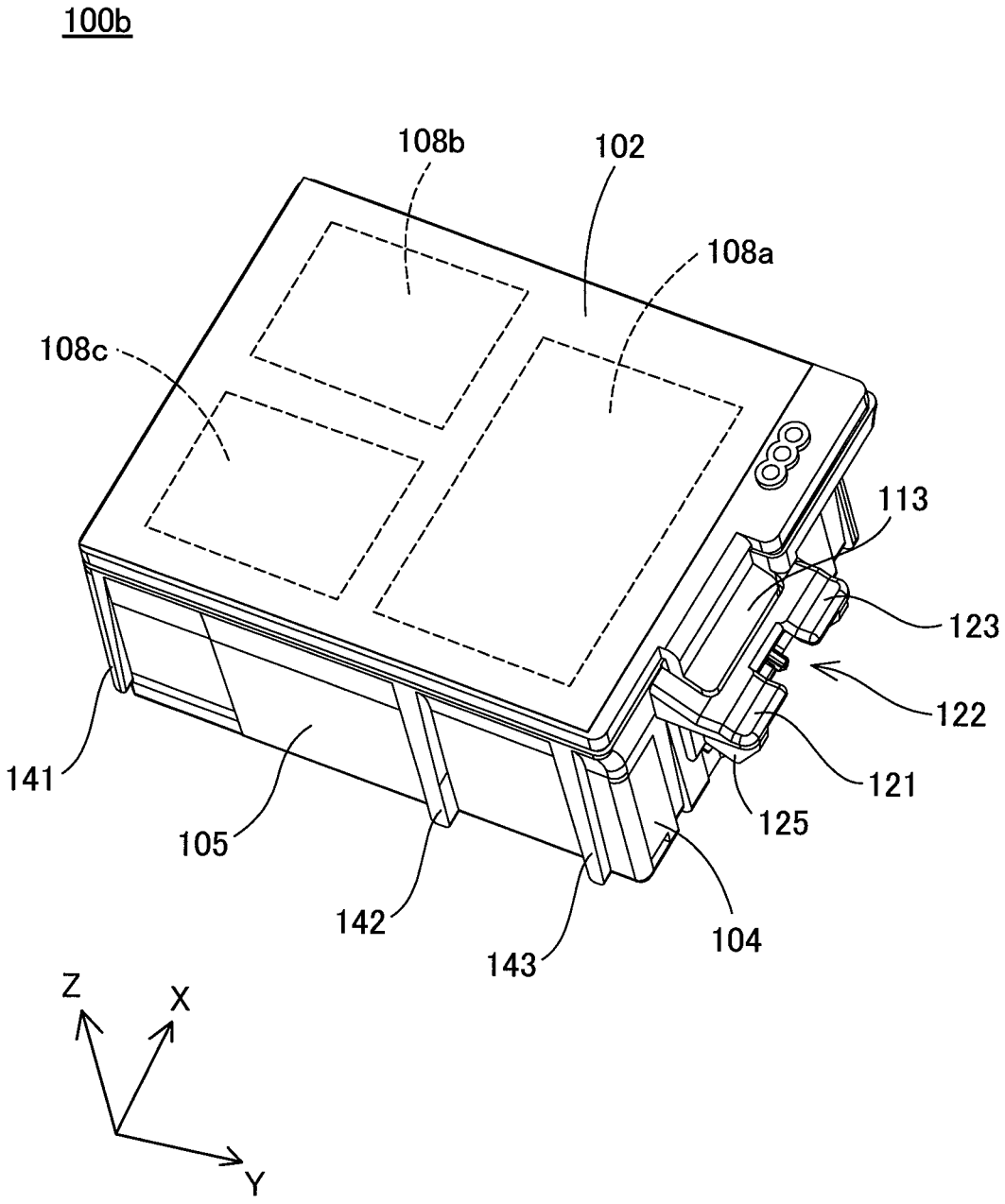
FIG. 10 is a perspective top view illustrating the second cartridge.
Figure 11:
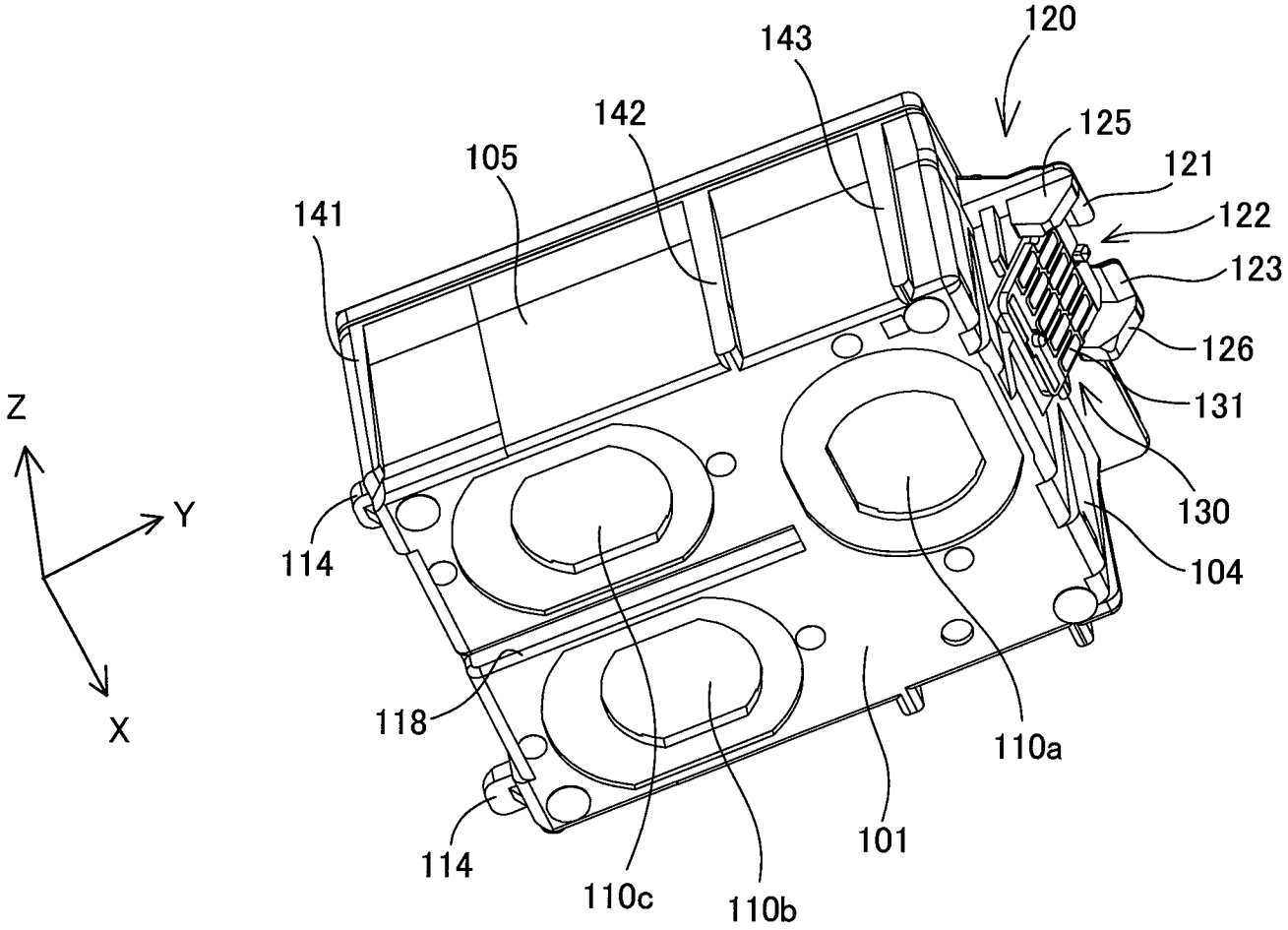
FIG. 11 is a perspective bottom view illustrating the second cartridge.
Figure 12:
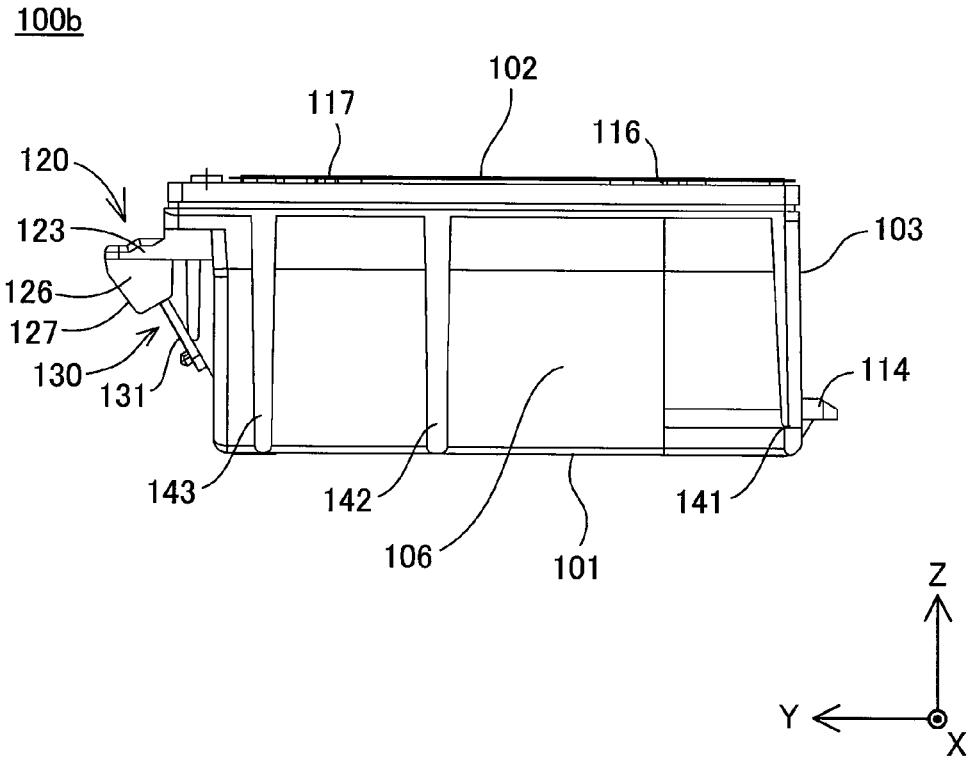
FIG. 12 is a side view illustrating the second cartridge.
Figure 13:
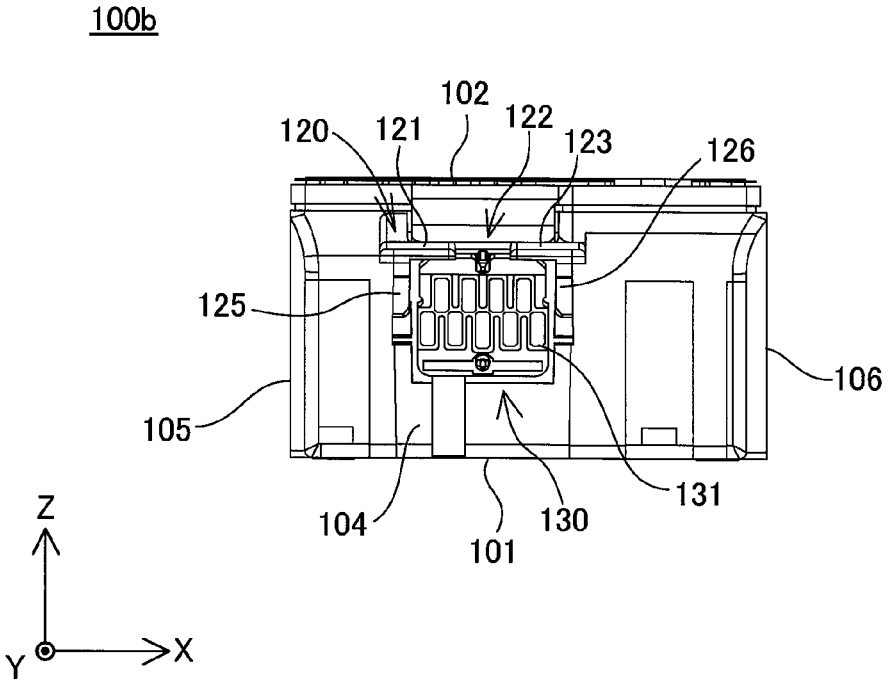
FIG. 13 is a front view illustrating the second cartridge.

The detailed structure of the second cartridge 100*b* is described with reference to FIGS. 10 to 13. FIG. 10 is a perspective top view illustrating the second cartridge 100*b*. As a matter of convenience, ink chambers 108*a* to 108*c* formed inside of the second cartridge 100*b* are illustrated by the broken line in FIG. 10. FIG. 11 is a perspective bottom view illustrating the second cartridge 100*b*. FIG. 12 is a side view illustrating the second cartridge 100*b*. FIG. 13 is a front view illustrating the second cartridge 100*b*. In FIGS. 10 to 13, the like components to those of the first cartridge 100*a* described above with reference to FIGS. 4 to 8 are expressed by the like numerical symbols.

The second cartridge 100*b* has the appearance in an approximately rectangular parallelepiped shape as described above and has six walls 101 to 106 corresponding to the walls 101 to 106 of the first cartridge 100*a*. The inside of the second cartridge 100*b* is parted into three ink chambers 108*a* to 108*c* configured to separately contain three different color inks.

The first ink chamber 108*a* is formed in a front area facing the fourth wall 104. The second and the third ink chambers 108*b* and 108*c* are formed by dividing an area behind the first ink chamber 108*a* into two parts in the direction of the arrow X. The second ink chamber 108*b* is formed on the side facing the fifth wall 105, and the third ink chamber 108*c* is formed on the side facing the sixth wall 106.

The first wall 101 shown in FIG. 11 has three ink supply ports 110*a* to 110*c* formed corresponding to the respective ink chambers 108*a* to 108*c*. The first ink supply port 110*a* is formed to have its center at a position substantially aligned with the center in the direction of the arrow X of the main engagement part 120 provided on the fourth wall 104. The second ink supply port 110*b* and the third ink supply port 110*c* are formed on the respective centers of the second ink chamber 108*b* and the third ink chamber 108*c*.

A groove 118 extended linearly in the direction of the arrow Y is formed between the second and the third ink supply ports 110*b* and 110*c* at a position corresponding to the boundary between the second and the third ink chambers 108*b* and 108*c*. The groove 118 serves as an engaged part to be engaged with a second sub-wall member (described later) of the holder structure 200 when the second cartridge 100*b* is attached to the holder structure 200.

The second wall 102 shown in FIG. 10 has substantially similar structure to that of the second wall 102 of the first cartridge 100*a*, except a different width in the direction of the arrow X and a different location where an extended section 113 is formed. In the second cartridge 100*b*, the extended section 113 is formed at a position shifted from the center in the direction opposite to the direction of the arrow X at the edge adjacent to the fourth wall 104. The third wall 103 shown in FIG. 12 has substantially similar structure to that of the third wall 103 of the first cartridge 100*a*, except a different width in the direction of the arrow X.

The fourth wall 104 shown in FIGS. 10 and 11 has substantially similar structure to that of the fourth wall 104 of the first cartridge 100*a*, except a different location where a main engagement part 120 is formed. In the second cartridge 100*b*, the main engagement part 120 is formed at a position shifted from the center in the direction opposite to the direction of the arrow X at the edge adjacent to the second wall 102. This configuration causes the respective main engagement parts 120 to be arranged adjacent to and close to each other when the first and the second cartridges 100*a* and 100*b* are attached to the holder structure 200 shown in FIG. 3. The fifth wall 105 shown in FIGS. 10 and 11 and the sixth wall 106 shown in FIG. 12 respectively have substantially similar structures to those of the fifth wall 105 and the sixth wall 106 of the first cartridge 100*a*.

[Configuration of Holder Structure]

Figure 14:
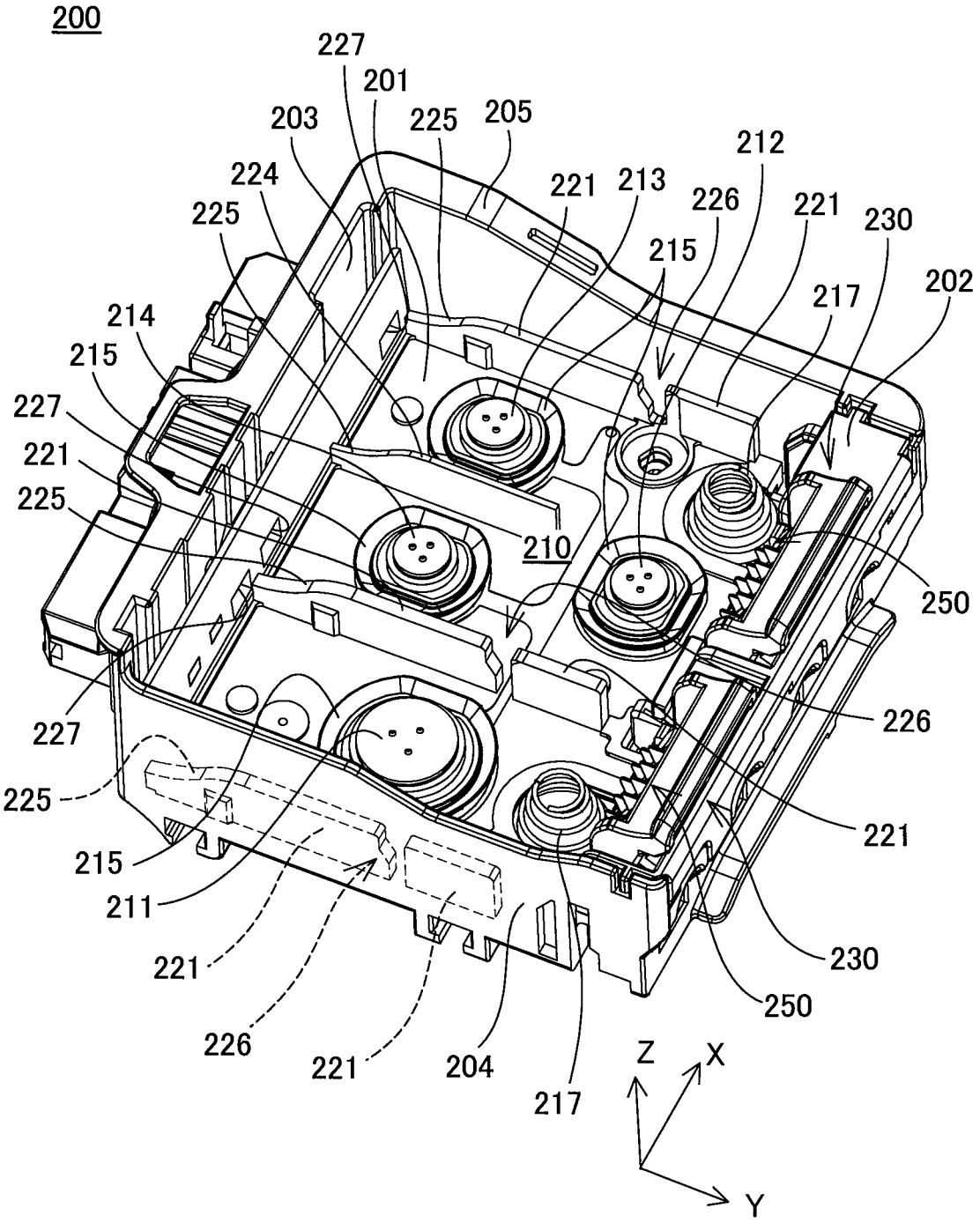
FIG. 14 is a perspective top view illustrating the holder structure from a front side.
Figure 15:
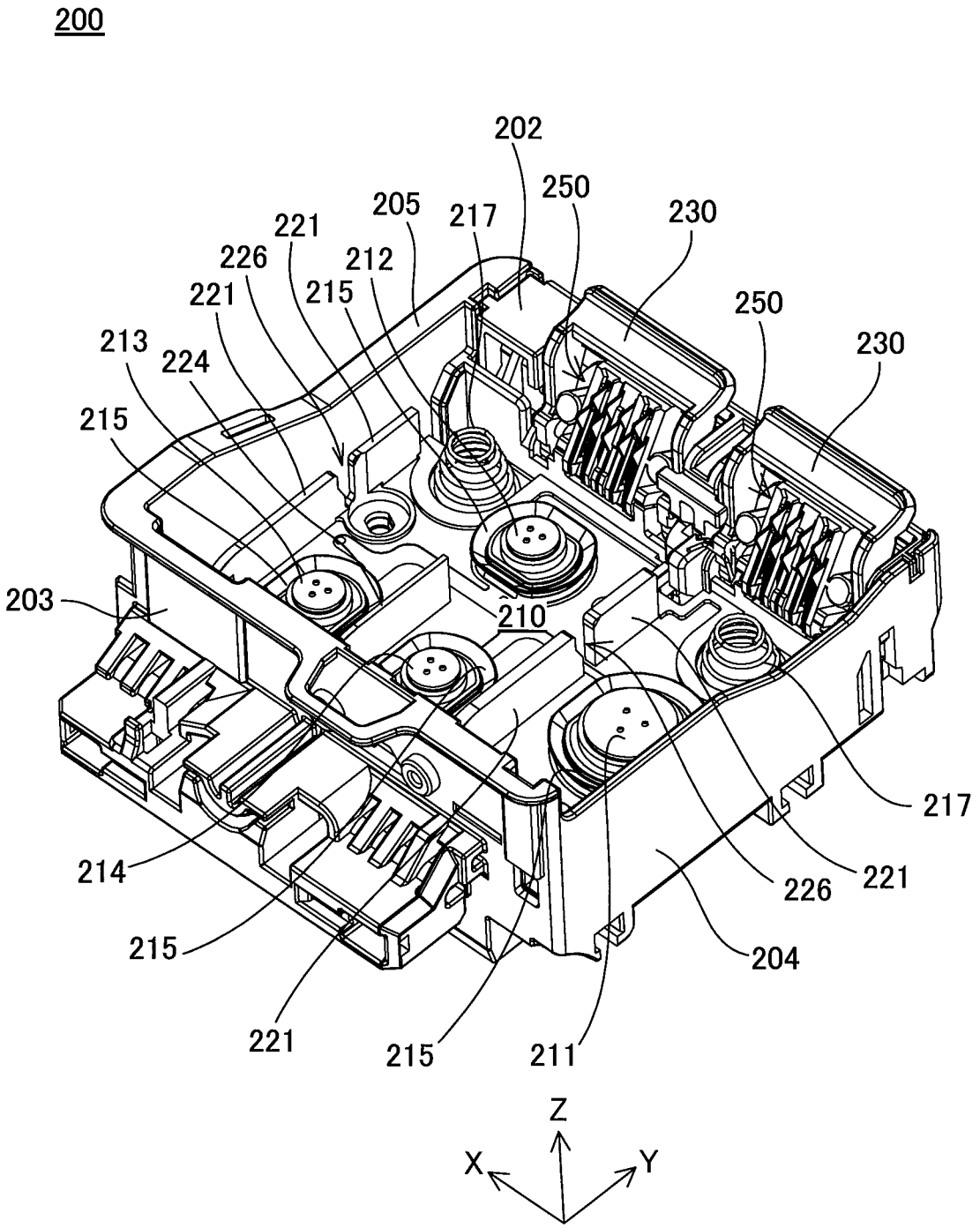
FIG. 15 is a perspective top view illustrating the holder structure from a rear side.
Figure 16:
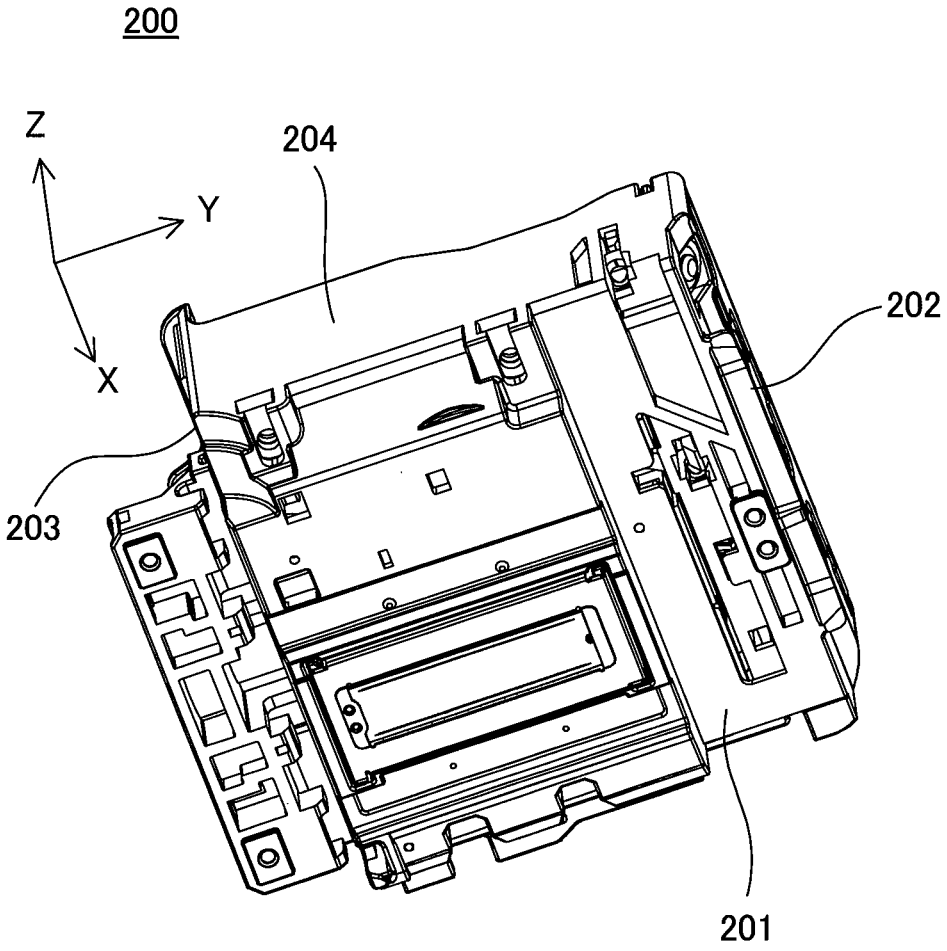
FIG. 16 is a perspective bottom view illustrating the holder structure.

The general configuration of the holder structure 200 is described with reference to FIGS. 14 to 16. FIG. 14 is a perspective top view illustrating the holder structure 200 from the front side. FIG. 15 is a perspective top view illustrating the holder structure 200 from the rear side. FIG. 16 is a perspective bottom view illustrating the holder structure 200. The holder structure 200 is formed as the approximately rectangular parallelepiped box-like member having the upper opening as described above. The holder structure 200 has five walls 201 to 205 arranged to surround a cartridge chamber 210 which receives the first and the second cartridges 100*a* and 100*b* placed therein.

The bottom wall 201 forms a bottom surface of the cartridge chamber 210 and serves as a mounting area on which the respective cartridges 100*a* and 100*b* are placed. The front wall 202 and the rear wall 203 are respectively extended substantially vertically upward from a front-side end and a rear-side end of the bottom wall 201 to form a front surface and a rear surface of the cartridge chamber 210. The first side wall 204 and the second side wall 205 are respectively extended substantially vertically upward from a left-side end and a right-side end of the bottom wall 201 to form a left side surface and a right side surface of the cartridge chamber 210.

The bottom wall 201 has ink receiving parts 211 to 214 shown in FIGS. 14 and 15 to be connected respectively with the ink supply port 100 of the first cartridge 100 and with the ink supply ports 100*a* to 100*c* of the second cartridge 100*b*. The respective ink receiving parts 211 to 214 correspond to the liquid introduction conduit. A seal member 215 is provided on the outer periphery of each of the ink receiving parts 211 to 214 to suppress invasion of the air to the ink flow path, as well as leakage of ink to outside.

The bottom wall 201 has pressing mechanisms 217 configured to respectively press upward the first and the second cartridges 100*a* and 100*b*. According to this embodiment, the pressing mechanisms 217 are made by helical springs. Each of the pressing mechanisms 217 is located at a position adjacent to a lever member 230. This configuration enhances the engagement force between the main engagement parts 120 and the lever members 230 which are to be engaged with each other in the state of attachment of the first and the second cartridges 100*a* and 100*b* and enhances the attachment of the first and the second cartridges 100*a* and 100*b* to the holder structure 200. In the course of detachment of the first or the second cartridge 100*a* or 100*b* from the holder structure 200, the pressing mechanism 217 presses upward the first or the second cartridge 100*a* or 100*b*, so as to enhance the operability of detachment.

The bottom wall 201 also has first sub-wall members 221 and a second sub-wall member 224 which are arranged parallel to the first side wall 204 and the second side wall 205 and have lower heights. The first sub-wall members 221 are provided at the positions adjacent to the first side wall 204 and adjacent to the second side wall 205 and at the position corresponding to the boundary position between the first and the second cartridges 100*a* and 100*b*. The second sub-wall member 224 is provided at the position corresponding to the boundary position between the second and the third ink chambers 108*b* and 108*c* in the area where the second cartridge 100*b* is attached.

The first sub-wall member 221 has a sloped section 225 formed on its rear end to have the height gradually decreasing backward. The first sub-wall member 221 also has a cut 226 in the middle of the cartridge chamber 210 in the direction of the arrow Y. The sloped sections 225 and the cuts 226 work as guides to guide the motions of the first and the second cartridges 100*a* and 100*b* in the course of attachment of the first and the second cartridges 100*a* and 100*b* to the holder structure 200. The description of the functions of the sloped sections 225 and the cuts 226 is described later in detail.

The second sub-wall member 224 has a sloped section 225 formed on its rear end, like the first sub-wall member 221. The sloped section 225 of the second sub-wall member 224 also works as a guide to guide the motion of the second cartridge 100*b* in the course of attachment of the second cartridge 100*b* to the holder structure 200. The second sub-wall member 224 is fit in the groove 118 shown in FIG. 11 formed in the first wall 101 of the second cartridge 100*b* and accordingly serves to fix the second cartridge 100*b*.

The lever members 230 as the rotating mechanism of rotating about the supporting point as the axis are provided on the front wall 202 shown in FIG. 15. Providing the lever members 230 on the front wall 202 facilitates the user's access to the lever members 230 for attachment and detachment of the first and the second cartridges 100*a* and 100*b*. Device-side terminal assemblies 250 are located below the respective lever members 230 to come into contact with the terminal assemblies 131 of the circuit substrates 130 of the first and the second cartridges 100*a* and 100*b*. The device-side terminal assembly 250 corresponds to the electrode assembly. The detailed structures of the lever member 230 and the device-side terminal assembly 250 will be described below.

A plurality of fitting holes 227 are provided at a lower edge of the cartridge chamber 210-side wall surface of the rear wall 203 shown in FIG. 14 to be arrayed in the direction of the arrow X. In the course of attachment of the first or the second cartridge 100*a* or 100*b*, the plurality of projections 114 shown in FIGS. 5 and 11 provided at the lower edge of the third wall 103 of each of the cartridges 100*a* and 100*b* are inserted and fit in the fitting holes 227.

Figure 17:
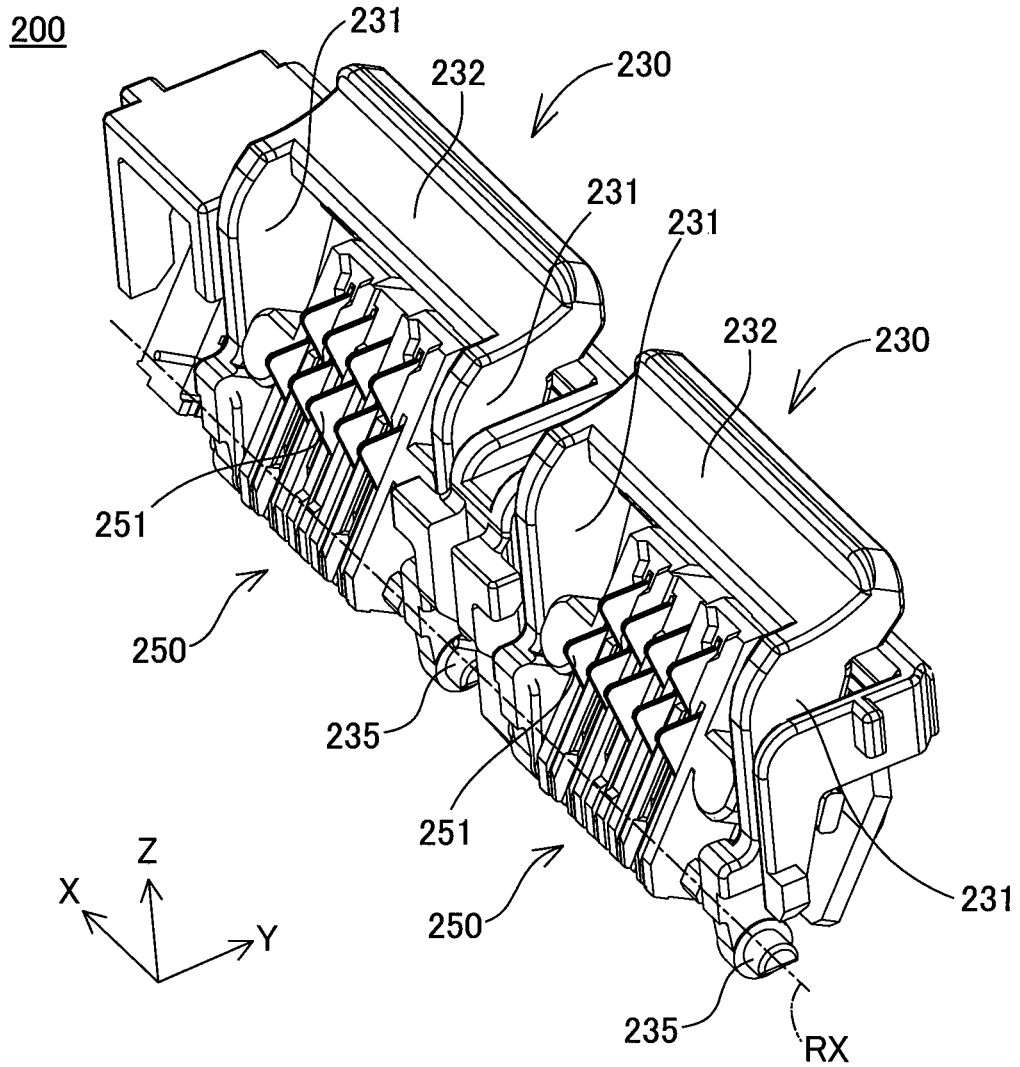
FIG. 17 is a perspective top view illustrating lever members and device-side terminal assemblies in a state attached to the holder structure.
Figure 18:
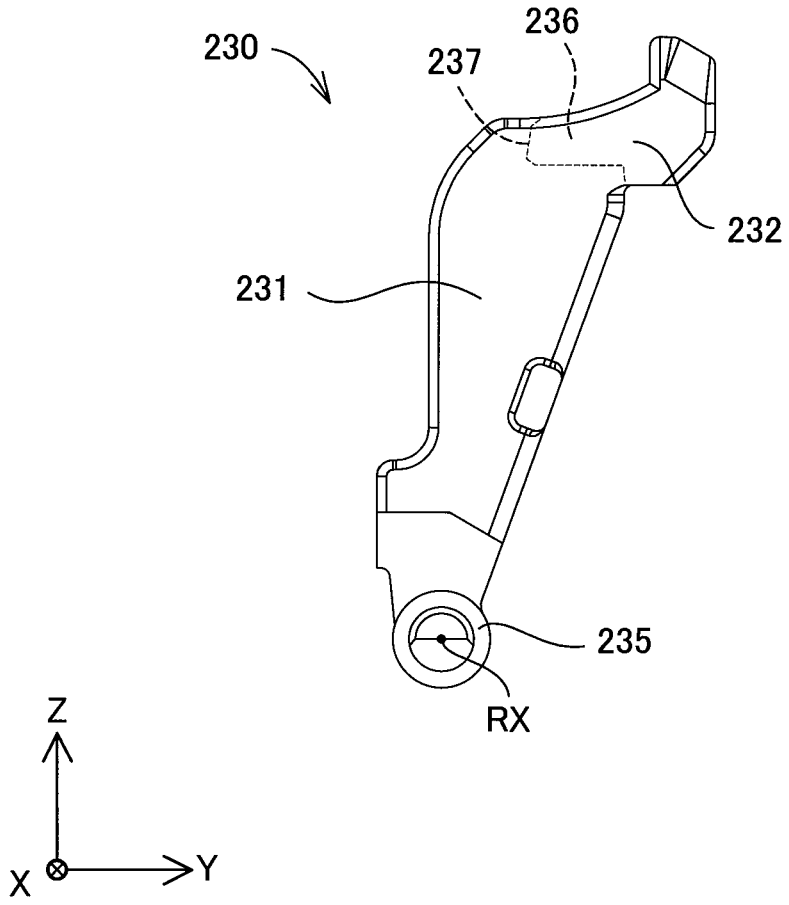
FIG. 18 is a side view illustrating the lever member.

The structures of the lever member 230 and the device-side terminal assembly 250 of the holder structure 200 are described with reference to FIGS. 17 and 18. FIG. 17 is a perspective top view illustrating the periphery of the lever members 230 and the device-side terminal assemblies 250 in the state attached to the front wall 202 of the holder structure 200. FIG. 18 is a side view illustrating the lever member 230. A rotation axis RX of the lever member 230 is illustrated in FIGS. 17 and 18.

The lever member 230 serves as an engaged part to be engaged with the main engagement part 120 of each of the first and the second cartridges 100*a* and 100*b*. The lever member 230 has two leg sections 231 extended in the direction of the arrow Z and a bridging section 232 arranged to bridge upper edges of the two leg sections 231. Each of the leg sections 231 has a convex 235 provided at its lower edge to be protruded outward in the direction of the arrow X.

The respective convexes 235 are fit in recesses (not shown in figures) formed in the front wall 202, so that the lever member 230 is attached to be rotatable in the front-back direction about center axes of the respective convexes 235 as the rotation axis RX. In the holder structure 200, the lever member 230 is pressed backward by a pressing mechanism (not shown in figures) and is stopped to rest at a specified angle of rotation.

The bridging section 232 of the lever member 230 has a flat plate part 236 shown in FIG. 18 linked at both ends with the leg sections 231 and extended forward. The flat plate part 236 corresponds to the engaged part which is to be engaged with the main engagement part 120 of each of the first and the second cartridges 100*a* and 100*b*. In the state that each of the first and the second cartridges 100*a* and 100*b* is attached to the holder structure 200, the lower surface of the flat plate part 236 is in surface contact with the upper surfaces of the respective brim sections 121 and 123 of the main engagement part 120 shown in FIGS. 5 and 11 of each of the cartridges 100*a* and 100*b*. As described later, a rear end face 237 of the flat plate part 236 comes into contact with the first side wall portion 125 and the second side wall portion 126 of the main engagement part 120 in the state of attachment of each of the first and the second cartridges 100*a* and 100*b*.

The device-side terminal assembly 250 shown in FIG. 17 is formed in a plate-like shape and has a plurality of terminals 251 arrayed on a rear surface corresponding to the respective terminals 151 to 159 of the terminal assembly 131 shown in FIG. 9 of each of the first and the second cartridges 100*a* and 100*b*. The respective terminals 251 are protruded in the thickness direction of the device-side terminal assembly 250. The respective terminals 251 are pressed in the protruding direction by a pressing mechanism (not shown in figures) placed inside of the device-side terminal assembly 250. The device-side terminal assembly 250 is fixed to the front wall 202 of the holder structure 200 independently of the lever member 230 to have an angle of inclination corresponding to the angle of inclination of the circuit substrate 130 of each of the first and the second cartridges 100*a* and 100*b*.

[Mounting Mechanism of Cartridge to Holder Structure]

Figure 19:
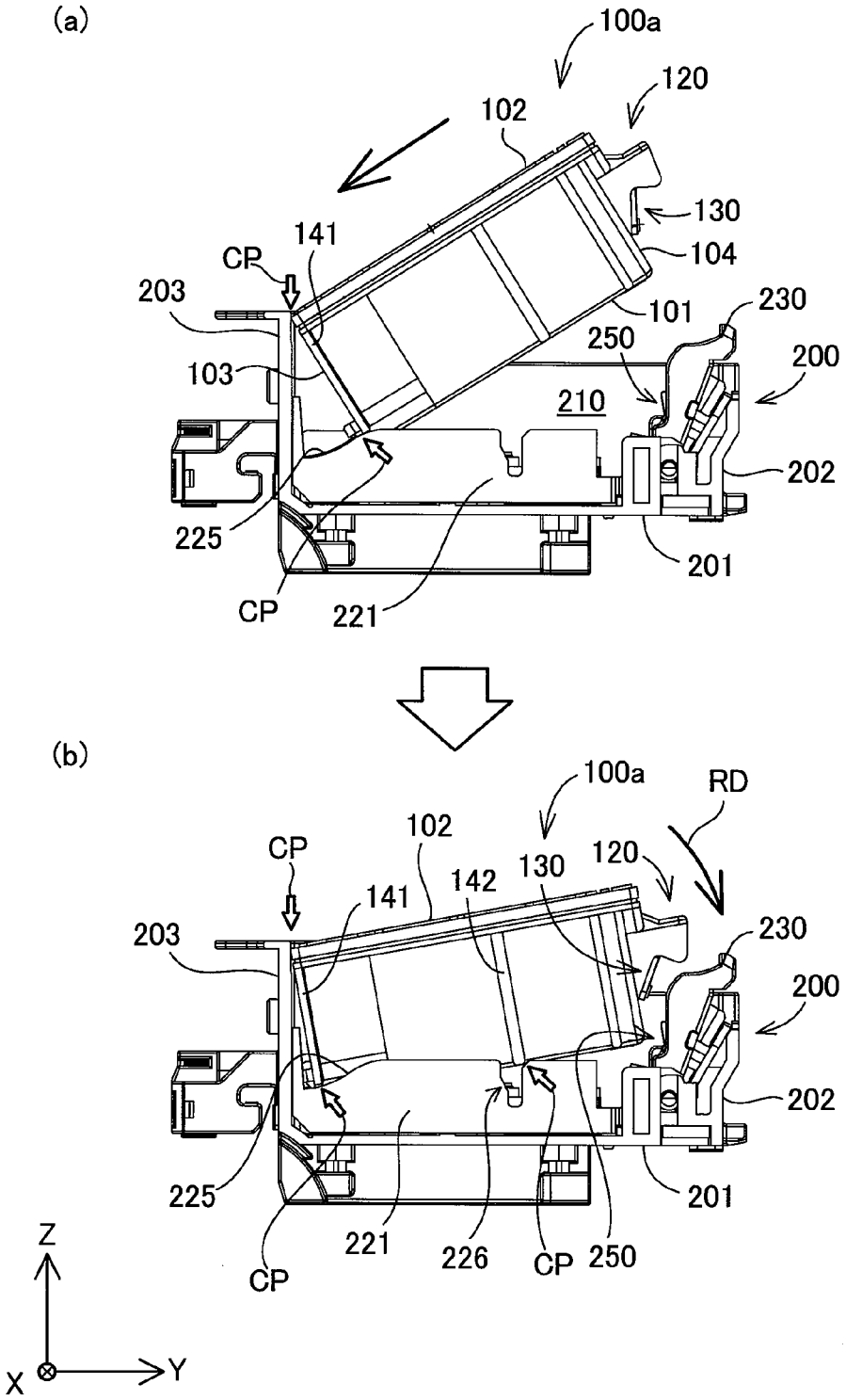
FIG. 19 is schematic diagrams illustrating an attachment process of the first cartridge to the holder structure in times series.
Figure 20:
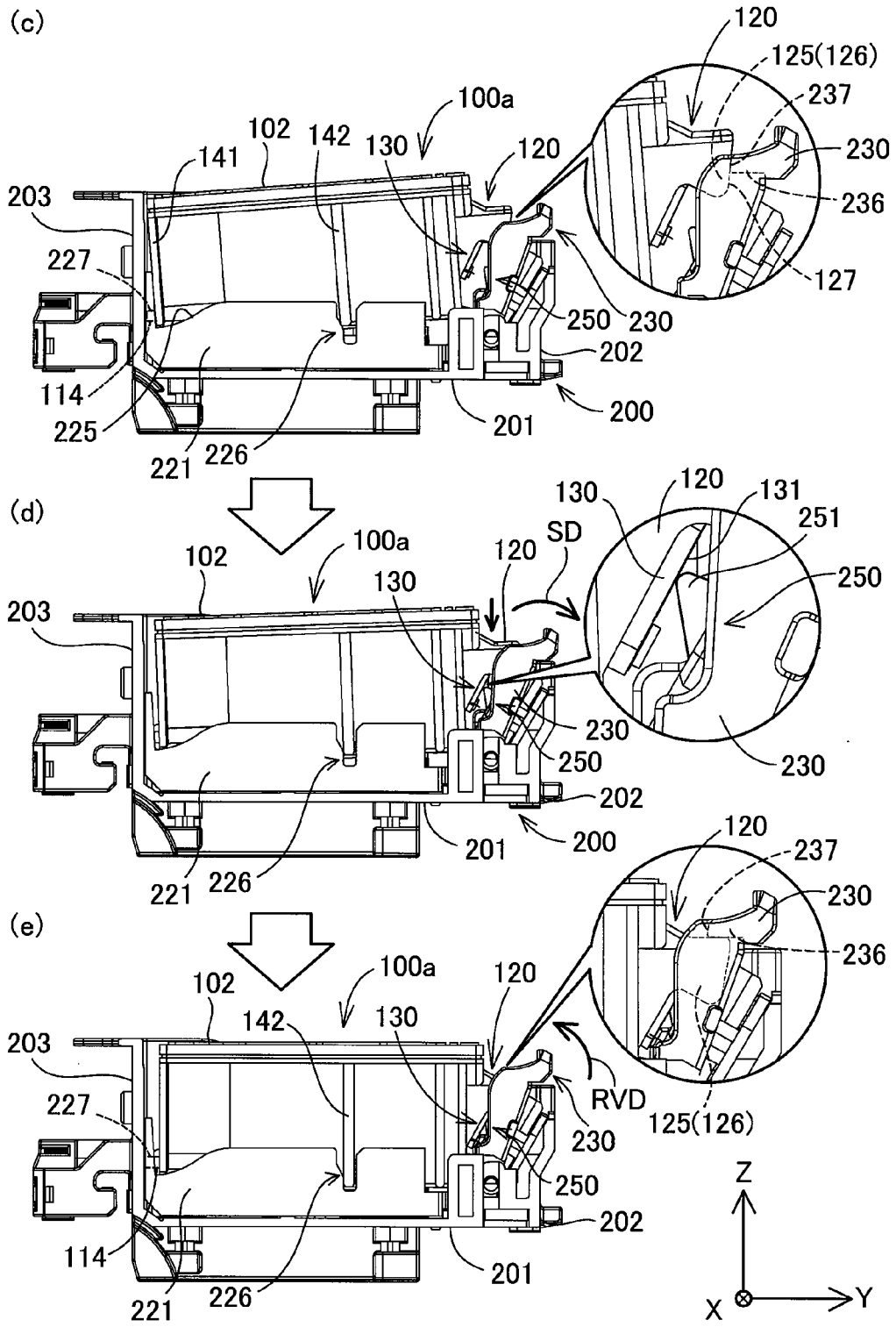
FIG. 20 is schematic diagrams illustrating the attachment process of the first cartridge to the holder structure in time series.

FIGS. 19 and 20 are schematic diagrams illustrating an attachment process of the first cartridge 100*a* to the holder structure 200 in time series. Sections (a) and (b) of FIG. 19 and sections (c), (d) and (e) of FIG. 20 sequentially show the process of attachment of the first cartridge 100*a* to the holder structure 200. As a matter of convenience, the first side wall 204 of the holder structure 200 is omitted from the illustrations of FIGS. 19 and 20. Arrows CP in FIG. 19 indicate the positions where the first cartridge 100*a* is in contact with the holder structure 200. The attachment process of the second cartridge 100*b* to the holder structure 200 is substantially the same as the attachment process of the first cartridge 100*a* and is thus neither specifically illustrated nor described herein.

In a first step shown in section (a) of FIG. 19, the first cartridge 100*a* is inclined with the third wall 103-side facing down and is brought closer to the holder structure 200. The upper edge of the third wall 103 of the first cartridge 100*a* then comes into contact with the upper edge of the rear wall 203 of the holder structure 200, whereas the lower edges of the first ribs 141 at the rear ends of the fifth wall 105 and the sixth wall 106 come into contact with the upper edges of the first sub-wall members 221.

In a second step shown in section (b) of FIG. 19, the first cartridge 100*a* is rotated and moved downward as shown by an arrow RD about the contact between the upper edge of the rear wall 203 of the holder structure 200 and the upper edge of the third wall 103 of the first cartridge 100*a* as the supporting point. In this state, the lower edges of the first ribs 141 slide and start moving along the upper surfaces of the sloped sections 225 of the first sub-wall members 221, while the lower edges of the second ribs 142 come into contact with the upper edges of the cuts 226 of the first sub-wall members 221. In the description herein, the term "sliding" means relatively moving in a friction-causing direction in the state of contact with another object.

In a third step shown in section (c) of FIG. 20, the main engagement part 120 of the first cartridge 100*a* comes into contact with the lever member 230 of the holder structure 200. More specifically, the front end faces 127 of the first side wall portion 125 and the second side wall portion 126 of the main engagement part 120 are in surface contact with two separate points of the end face 237 of the flat plate part 236 in the bridging section 232 of the lever member 230. These two points correspond to the first pressed part and the second pressed part. In this step, the plurality of projections 114 provided at the lower edge of the third wall 103 of the first cartridge 100*a* are inserted into the corresponding fitting holes 227 of the holder structure 200. The first cartridge 100*a* is then rotated and moved about the contacts between the projections 114 and the fitting holes 227 as the supporting points.

In a fourth step shown in section (d) of FIG. 20, the rotating and moving the first cartridge 100*a* continues, so that the main engagement part 120 moves downward. The bridging section 232 of the lever member 230 is pressed by the end faces 127 of the first side wall portion 125 and the second side wall portion 126 of the main engagement part 120 to be moved forward, i.e., in the direction away from the main engagement part 120 as shown by an arrow SD. In the description herein, "moving in the direction away from" is not limited to moving to be actually away from an object but also includes moving in a direction opposite to an object with keeping the distance from the object unchanged. In the first cartridge 100*a* of this embodiment, the lever member 230 is pressed to be rotated and moved by the main engagement part 120. This configuration does not require the rotating and moving action of the lever member 230 by the user's finger.

In the fourth step, each of the contact portions CP of the respective terminals 151 to 159 of the terminal assembly 131 on the circuit substrate 130 of the first cartridge 100*a* shown in FIG. 9 comes into contact with corresponding one of the plurality of terminals 251 of the device-side terminal assembly 250 of the holder structure 200. Accompanied with the downward move of the first cartridge 100*a*, the contact portions CP of the respective terminals 151 to 159 of the first cartridge 100*a* are slid against the surfaces of the corresponding terminals 251 of the holder structure 200. Such sliding removes extraneous matters such as stains or blots on the surfaces of the contact portions CP of the terminals, thus ensuring the better electric contact between the terminals.

In a fifth step shown in section (e) of FIG. 20, the rotating and moving the first cartridge 100*a* is completed, and the first wall 101 is supported by the bottom wall 201 of the holder structure 200. The lower edges of the second ribs 142 reach the lower edges of the cuts 226 of the first sub-wall members 221, so that the positions of the second ribs 142 are fixed. In this state, the plurality of projections 114 provided at the lower edge of the third wall 103 of the first cartridge 100*a* are inserted and fit in the corresponding fitting holes 227 of the holder structure 200. This serves as the engagement mechanism to stop the first cartridge 100*a* to the holder structure 200.

Additionally, in the fifth step, as the main engagement part 120 is moved to the lowermost position, the first side wall portion 125 and the second side wall portion 126 of the main engagement part 120 move away from the bridging section 232 of the lever member 230, so as to be released from the pressed state. Accordingly, the lever member 230 is returned to its rear-side initial position (as shown by an arrow RVD) by the pressing mechanism at its lower end, and its bridging section 232 moves above the respective brim sections 121 and 123 of the main engagement part 120. The upper surfaces of the respective brim sections 121 and 123 are then in surface contact with the lower surface of the flat plate part 236 of the lever member 230, so that the main engagement part 120 is engaged with the lever member 230. This series of steps causes the first cartridge 100*a* to be attached to the holder structure 200.

Figure 21:
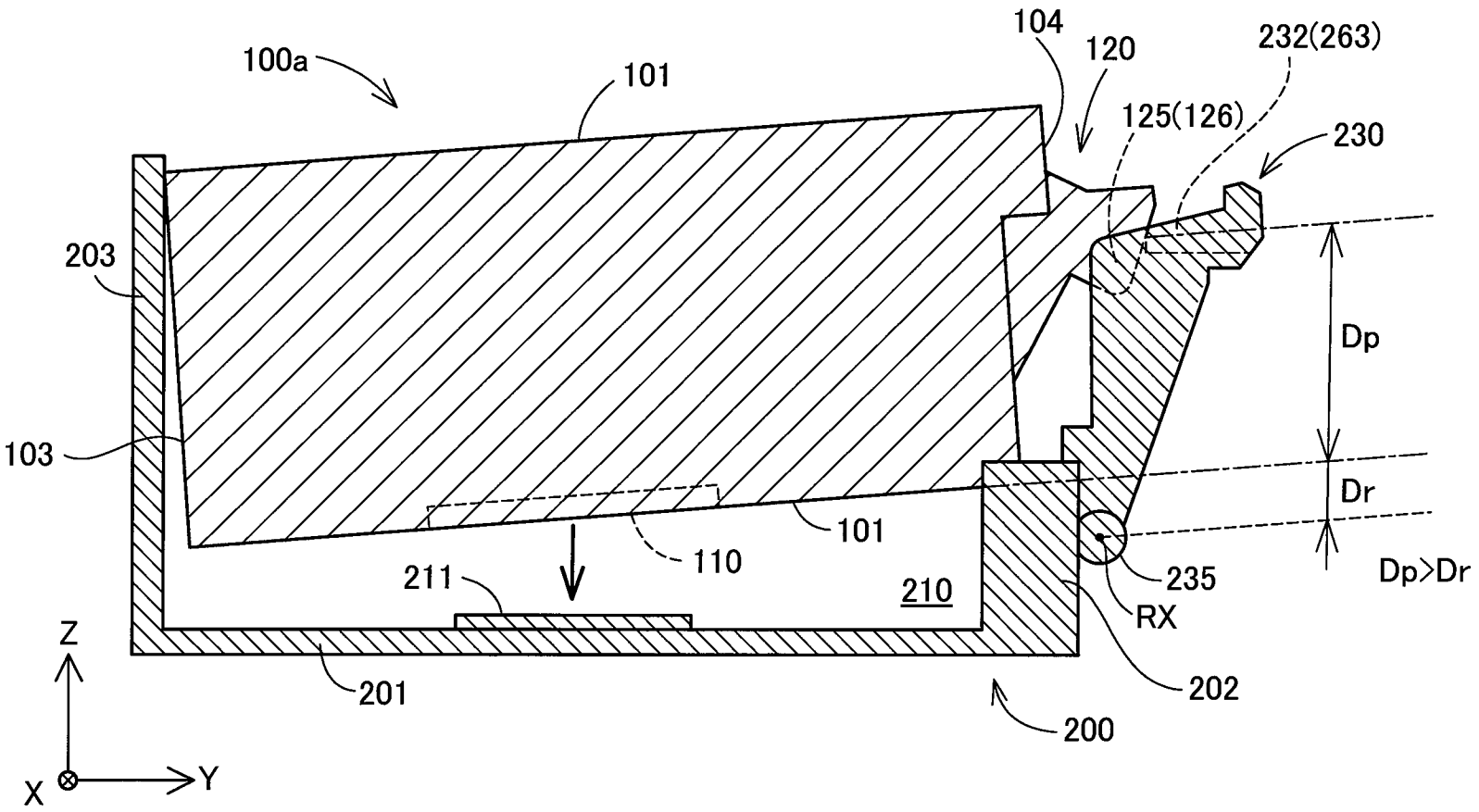
FIG. 21 is a diagram illustrating the functions of a first side wall portion and a second side wall portion included in a main engagement part.

FIG. 21 is a diagram illustrating the functions of the first side wall portion 125 and the second side wall portion 126 of the main engagement part 120. FIG. 21 schematically illustrates the state of rotating and moving the lever member 230 described above with reference to FIG. 20(*d*), in the side view along the direction of the arrow X. The following description regarding the first cartridge 100*a* with reference to FIG. 21 is also applicable to the second cartridge 100*b*. The first ink supply port 110*a* of the second cartridge 100*b* corresponds to the ink supply port 110 of the first cartridge 100*a*.

As described above, in the course of attachment of the first cartridge 100*a* to the holder structure 200, the bridging section 232 of the lever member 230 which is to be engaged with the main engagement part 120 is pressed to be rotated and moved forward by the first side wall portion 125 and the second side wall portion 126 of the main engagement part 120. The rotating motion of the lever member 230 provides the moving pathway (locus of attachment) of the first cartridge 100*a* toward the cartridge chamber 210 of the holder structure 200. Such functions of the first side wall portion 125 and the second side wall portion 126 of the main engagement part 120 allow for omission of the rotating operation of the lever member 230 by the user's finger. Additionally, the first side wall portion 125 and the second side wall portion 126 of the main engagement part 120 have the following functions.

The lever member 230 is rotated and moved as described above by the operation of the first side wall portion 125 and the second side wall portion 126 of the main engagement part 120 that presses the two separate points in the direction of the arrow X on the bridging section 232. The angle of the first cartridge 100*a* viewed in the direction of the arrow Z is defined by these two points of contact. In a configuration that the lever member 230 is attached through the contact at only one point on the bridging section 232, the angle of the first cartridge 100*a* viewed in the direction of the arrow Z is not defined. In other words, in the first cartridge 100*a* of the embodiment, the first side wall portion 125 and the second side wall portion 126 of the main engagement part 120 have the function of defining the locus of attachment of the first cartridge 100*a*.

In the description herein, the direction in which the ink supply port 110 of the first cartridge 100*a* moves toward the ink receiving part 211 of the holder structure 200 during the rotating motion of the lever member 230 is called "supply port connecting direction". The supply port connecting direction may be interpreted as the direction of connecting the center of the ink supply port 110 with the center of the ink receiving part 211. According to this embodiment, the supply port connecting direction may be approximately interpreted as the direction from the second wall 102 toward the first wall 101 of the first cartridge 100*a* or may be approximately interpreted as the direction opposite to the direction of the arrow Z.

When the lever member 230 is rotated and moved by the first side wall portion 125 and the second side wall portion 126 of the main engagement part 120, a distance Dp in the supply port connecting direction between the ink supply port 110 and the points of contact of the first side wall portion 125 and the second side wall portion 126 with the bridging section 232 is longer than a distance Dr in the supply port connecting direction between the ink supply port 110 and the rotation axis RX as the supporting point of the rotating motion of the lever member 230. In other words, when the lever member 230 is pressed to be rotated and moved by the main engagement part 120, the points of contact of the respective side walls portions 125 and 126 are located at the positions farther in the supply port connecting direction from the first wall 101 with the ink supply port 110 than the rotation axis RX of the lever member 230.

As described above, the first cartridge 100*a* is configured to press the bridging section 232 of the lever member 230 at the positions having the sufficient distance from the rotation axis RX of the lever member 230. This configuration reduces the user's force to be applied to the first cartridge 100*a* for rotating and moving the lever member 230 in accordance with the principle of leverage. This facilitates the attachment operation of the first cartridge 100*a* to the holder structure 200 and enhances the attachment. More specifically, in the configuration of this embodiment, the first cartridge 100*a* is rotated and moved about the upper edge of the third wall 103 as the supporting point, and the lever member 230 is brought into contact with the main engagement part 120 on the fourth wall 104 so as to be rotated and moved. This action also takes advantage of the principle of leverage and thereby further reduces the user's force to be applied in the course of attachment of the first cartridge 100*a* to the holder structure 200.

Figure 22:
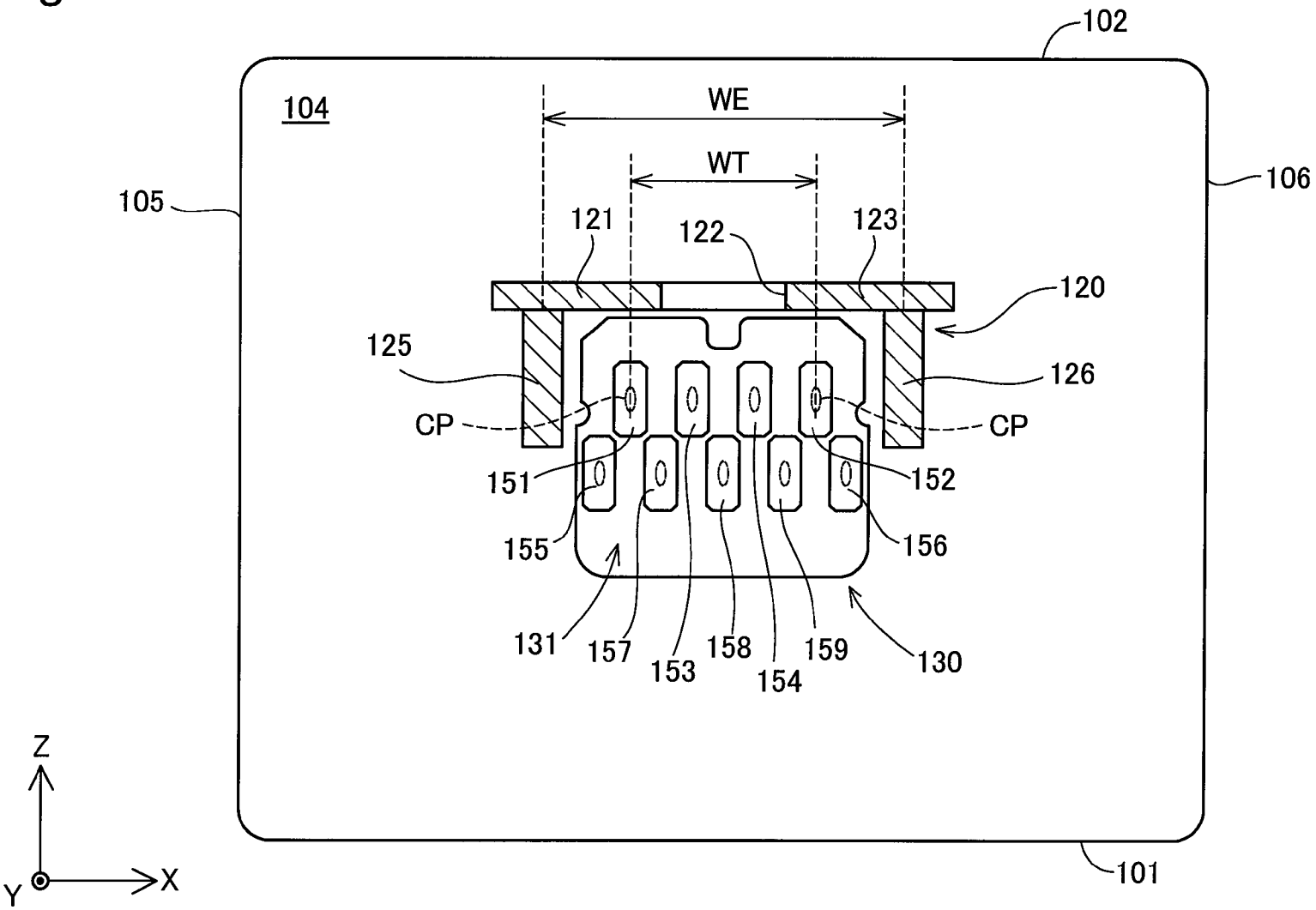
FIG. 22 is a schematic diagram illustrating the positional relationship between the main engagement part and the circuit substrate in the first cartridge.

FIG. 22 is a schematic diagram illustrating the positional relationship between the main engagement part 120 and the circuit substrate 130 in the first cartridge 100*a*. FIG. 22 schematically illustrates the positional relationship between the main engagement part 120 and the circuit substrate 130 in the view of the first cartridge 100*a* facing the fourth wall 104. The following description regarding the first cartridge 100*a* with reference to FIG. 22 is also applicable to the second cartridge 100*b*.

In the first cartridge 100*a*, a distance WE between the first side wall portion 125 and the second side wall portion 126 in the terminal array direction shown by the arrow X of the circuit substrate 130 is greater than a distance WT which is an interval between the contact portion CP of the first terminal 151 and the contact portion CP of the second terminal 152 (WE>WT). The distance WE denotes a distance between the centerlines of the first side wall portion 125 and the second side wall portion 126 in the terminal array direction. The distance WT denotes a distance between the centerlines of the contact portions CP of the first and the second terminals 151 and 152 in the terminal array direction. Even when the first cartridge 100*a* is inclined to a specified angle in the course of attachment to the holder structure 200, the above relationship of the distances WE and WT reduces the amounts of positional misalignment of the contact portions CP of the first and the second terminals 151 and 152 from their specified positions to be less than the amounts of positional misalignment of the respective side wall portions 125 and 126. This suppresses the occurrence of contact failure of the first and the second terminals 151 and 152 and also ensures the electrical connectivity of the other terminals 153 to 159.

In the first cartridge 100*a* of the embodiment, the distance from the fifth wall 105 to the first side wall portion 125 is shorter than the distance from the fifth wall 105 to the contact portion CP of the first terminal 151. Similarly the distance from the sixth wall 106 to the second side wall portion 126 is shorter than the distance from the sixth wall 106 to the contact portion CP of the second terminal 152. In other words, the contact portions CP of the first and the second terminals 151 and 152 are located closer to the center area than the first side wall portion 125 and the second side wall portion 126 in the direction of the arrow X. More specifically, in the first cartridge 100*a* of the embodiment, the center position between the first side wall portion 125 and the second side wall portion 126 in the direction of the arrow X is identical with the center position between the contact portions CP of the first and the second terminals 151 and 152. Accordingly this further reduces the positional misalignment of the contact portions CP of the first and the second terminals 151 and 152 from their specified positions.

Additionally, in the configuration of the embodiment, the contact portions CP of the first and the second terminals 151 and 152 are located between the first side wall portion 125 and the second side wall portion 126. The first side wall portion 125 and the second side wall portion 126 are more protruded in the direction of the arrow Y than the contact portions CP of the first and the second terminals 151 and 152. This configuration suppresses the user's finger from coming into contact with the contact portions CP of the first and the second terminals 151 and 152, while suppressing the contact portions CP of the first and the second terminals 151 and 152 from directly hitting against the surface in the event of an accidental fall of the first cartridge 100*a*. More specifically, in the first cartridge 100*a* of the embodiment, the first brim section 121 and the second brim section 123 are provided above the circuit substrate 130 to be extended toward the front side compared with the contact portions CP of the respective terminals 151 to 159 on the circuit substrate 130. The configuration of this embodiment ensures the protection of the circuit substrate 130 by the wall parts arranged in the three different directions.

Figure 23:
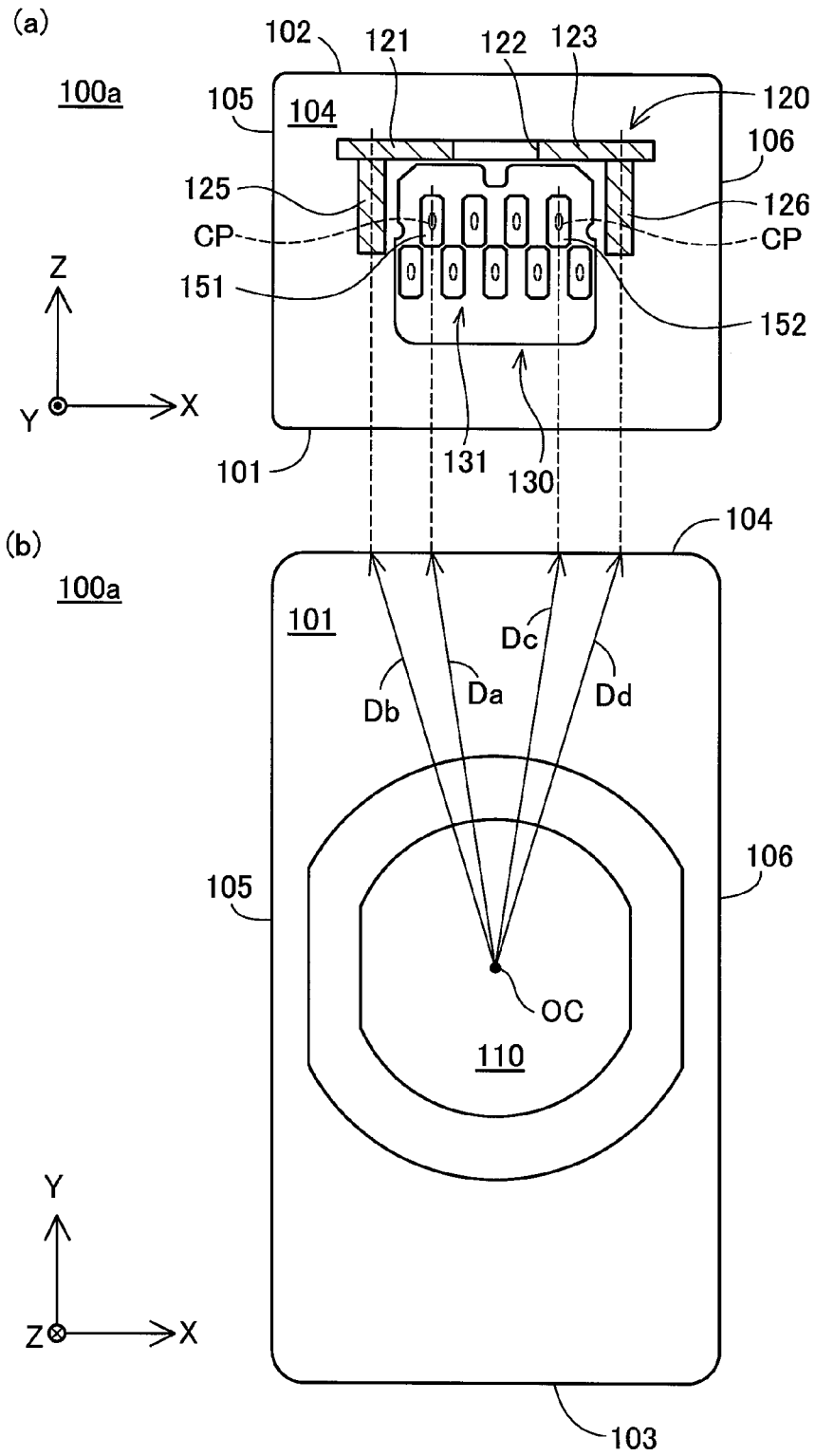
FIG. 23 is a schematic diagram illustrating the positional relationship between the first and the second side wall portions and an ink supply port.

FIG. 23 is a schematic diagram illustrating the positional relationship between the first and the second side wall portions 125 and 126 and the ink supply port 110. FIG. 23(*a*) schematically illustrates the fourth wall 104 in the plan view in the direction opposite to the direction of the arrow Y. FIG. 23(*b*) schematically illustrates the first wall 101 in the plan view in the direction of the arrow Z in such a manner as to correspond to the upper drawing of the fourth wall 104. The following description regarding the ink supply port 110 of the first cartridge 100*a* with reference to FIG. 23 is also applicable to the first ink supply port 110*a* of the second cartridge 100*b*.

In the first 100*a*, a distance Da from a center OC of the ink supply port 110 to the contact portion CP of the first terminal 151 is shorter than a distance Db from the center OC of the ink supply port 110 to the first side wall portion 125 of the main engagement part 120 in the plan view in the direction of the arrow Z. Similarly, a distance Dc from the center OC of the ink supply port 110 to the contact portion CP of the second terminal 152 is shorter than a distance Dd from the center OC of the ink supply port 110 to the second side wall portion 126 of the main engagement part 120.

As described above, in the first cartridge 100*a*, the contact portion CP of the first terminal 151 is located between the first side wall portion 125 and the ink supply port 110 in the direction of the arrow X. The contact portion CP of the second terminal 152 is located between the ink supply port 110 and the second side wall portion 126 in the direction of the arrow X. Accordingly, the position of the contact portion CP of the first terminal 151 is defined by the positions of the first side wall portion 125 and the ink supply port 110 in the course of attachment of the first cartridge 100*a* to the holder structure 200. Similarly the position of the contact portion CP of the second terminal 152 is defined by the positions of the second side wall portion 126 and the ink supply port 110. This reduces the positional misalignment of the contact portions CP of the first and the second terminals 151 and 152 in the state that the ink supply port 110 is adequately connected with the ink receiving part 211 and enhances the electrical connectivity. This also improves the detection accuracy of the state of attachment of the first cartridge 100*a*.

Additionally, in the first cartridge 100*a* of the embodiment, the first side wall portion 125 and the second side wall portion 126 are provided on the respective brim sections 121 and 123 of the main engagement part 120. The two distances Db and Dd described above correspond to the distances from the center OC of the ink supply port 110 to the engagement areas at the main engagement part 120. In the first cartridge 100*a* of the embodiment, the force applied to the first cartridge 100*a* by the engagement of the main engagement part 120 with the lever member 230 is increased to the force according to the distances Db and Dd in the ink supply port 110 by taking into account the principle of leverage. This enhances the connectivity of the ink supply port 110.

As described above, the first cartridge 100*a* of the embodiment is attached to the holder structure 200 specifically by the rotating motion about the point of contact between the upper edge of the third wall 103 and the rear wall 203 of the holder structure 200 as the supporting point shown in FIGS. 19 and 20. In this attachment process, the external force applied to the first cartridge 100*a* during the downward move of the fourth wall 104 is increased as the force of pressing the ink supply port 110 against the ink receiving part 211 by the principle of leverage. This further enhances the connectivity of the ink supply port 110.

As described above, the presence of the first side wall portion 125 and the second side wall portion 126 enhances the attachment of each of the first and the second cartridges 100*a* and 100*b* of the embodiment to the holder structure 200 of the printing device 10. This also improves the operability during attachment and detachment of each of the first and the second cartridges 100*a* and 100*b* to and from the holder structure 200.

B. Second Embodiment

Figure 24:
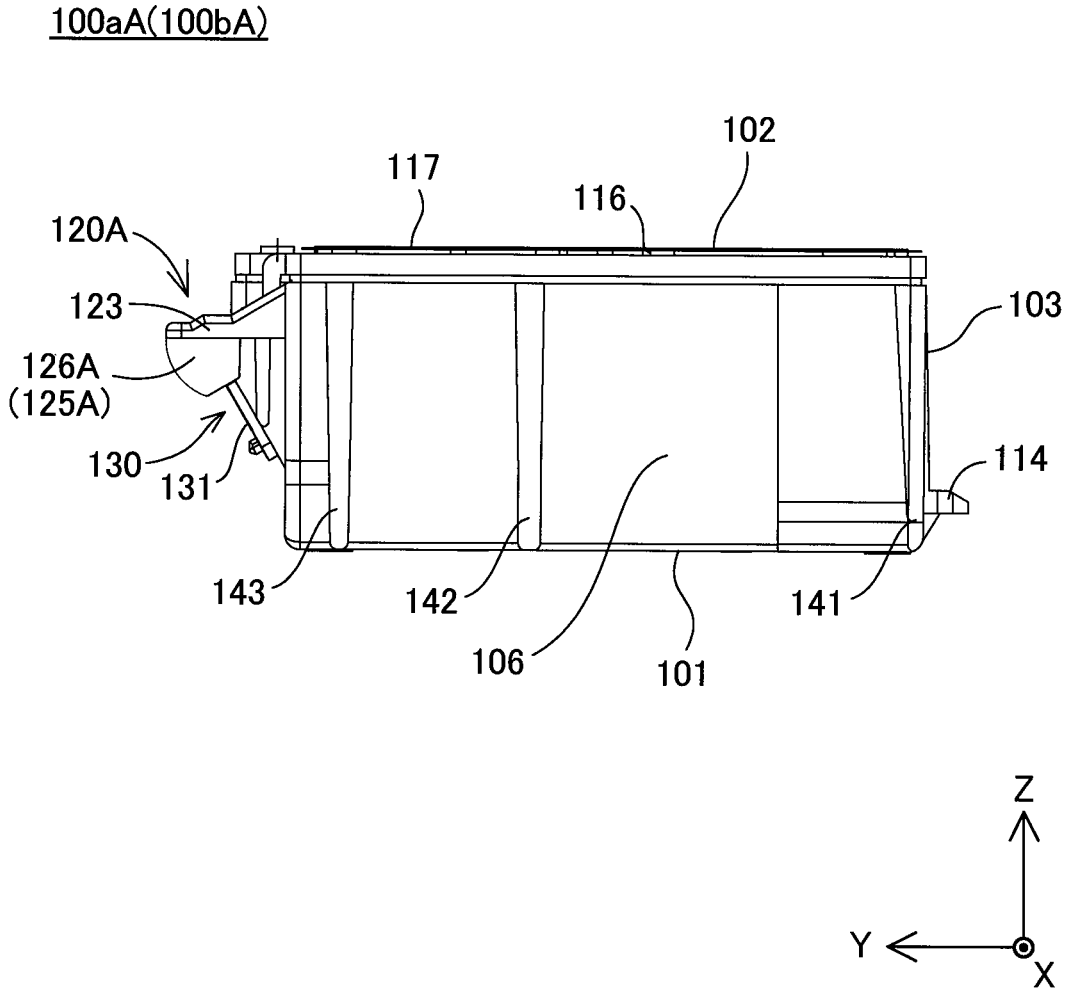
FIG. 24 is schematic side view illustrating a first cartridge according to a second embodiment.

FIG. 24 is a schematic side view illustrating a first cartridge 100*a*A according to a second embodiment of the invention viewed in the direction of the arrow X. The first cartridge 100*a*A of the second embodiment has configuration substantially similar to that of the first cartridge 100*a* of the first embodiment, except a first side wall portion 125A and a second side wall portion 126A of the main engagement part 120 in a different shape. The first cartridge 100*a*A of the second embodiment, as well as a second cartridge 100*b*A, is attachable to and detachable from the holder structure 200 shown in FIGS. 14 to 16 of the printing device 10 shown in FIGS. 1 and 2 described in the first embodiment. The second cartridge 100*b*A of the second embodiment has configuration substantially similar to that of the second cartridge 100*b* of the first embodiment, except a first side wall portion 125A and a second side wall portion 126A like those of the first cartridge 100*a*A. Illustration and the detailed description of the second cartridge 100*b*A of the second embodiment are thus omitted.

The first side wall portion 125A and the second side wall portion 126A of the second embodiment have end faces 127A which are not planar surfaces but are curved surfaces. In this configuration, the first side wall portion 125A and the second side wall portion 126A define the angle of each of the first and the second cartridges 100*a*A and 100*b*A in the course of attachment of the first or the second cartridge 100*a*A or 100*b*A to the holder structure 200. The first side wall portion 125A and the second side wall portion 126A also facilitate the rotating motion of the lever member 230 of the holder structure 200. Additionally, the first and the second cartridges 100*a*A and 100*b*A of the second embodiment have similar functions and advantageous effects to those of the first and the second cartridges 100*a* and 100*b* of the first embodiment.

C. Third Embodiment

Figure 25:
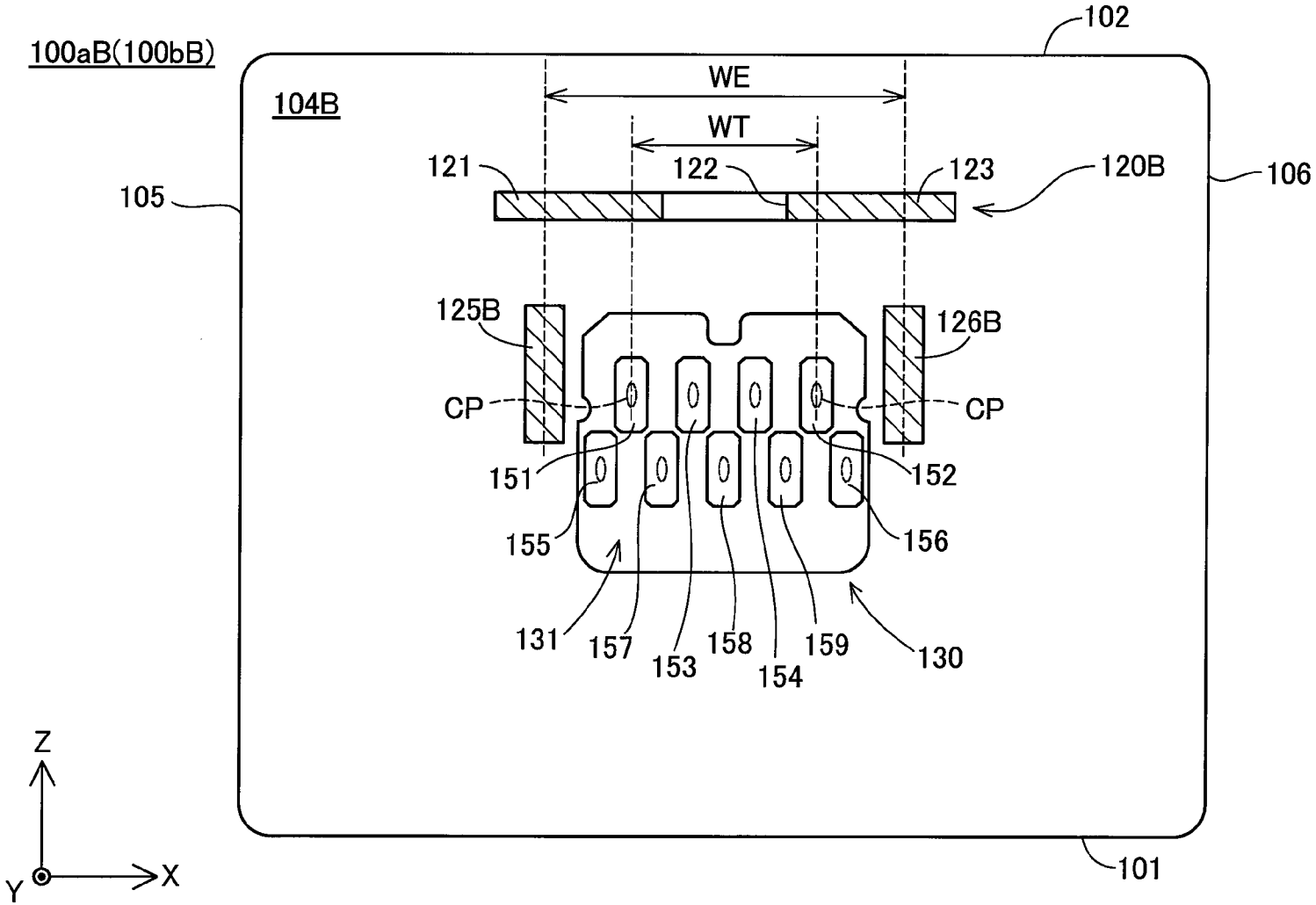
FIG. 25 is a schematic diagram illustrating a front view of a first cartridge according to a third embodiment.

FIG. 25 is a schematic diagram illustrating a first cartridge 100*a*B according to a third embodiment of the invention in the front view in the direction of the arrow Y. The configuration of FIG. 25 is substantially similar to the configuration of FIG. 22, except that a first side wall portion 125B and a second side wall portion 126B are provided separately from a main engagement part 120B. The first cartridge 100*a*B of the third embodiment has configuration substantially similar to that of the first cartridge 100*a* of the first embodiment, except the following differences. The first cartridge 100*a*B of the third embodiment, as well as a second cartridge 100*b*B, is attachable to and detachable from the holder structure 200 shown in FIGS. 14 to 16 of the printing device 10 shown in FIGS. 1 and 2 described in the first embodiment. The second cartridge 100*b*B of the third embodiment has configuration substantially similar to that of the second cartridge 100*b* of the first embodiment, except a main engagement part 120B and first and second side wall portions 125B and 126B like those of the first cartridge 100*a*B. Illustration and the detailed description of the second cartridge 100*b*B of the third embodiment are thus omitted.

The first side wall portion 125B and the second side wall portion 126B are provided on both sides of the circuit substrate 130 on a fourth wall 104B of the first cartridge 100*a*B of the third embodiment. The first side wall portion 125B and the second side wall portion 126B are not linked with the brim sections 121 and 123 of the main engagement part 120B but are provided as wall parts protruded from the wall surface of the fourth wall 104B. Otherwise the first side wall portion 125B and the second side wall portion 126B have similar configuration to that of the first side wall portion 125 and the second side wall portion 126 of the first embodiment. In the main engagement part 120B of the first cartridge 100*a*B of the third embodiment, the first brim section 121 and the second brim section 123 are formed in approximately flat plate-like shape and are located at the positions away from the first side wall portion 125B and the second side wall portion 126B.

In the configuration of the third embodiment, the first side wall portion 125B and the second side wall portion 126B define the angle of each of the first and the second cartridges 100*a*B and 100*b*B in the course of attachment of the first or the second cartridge 100*a*B or 100*b*B to the holder structure 200. The first side wall portion 125B and the second side wall portion 126B also facilitate the rotating motion of the lever member 230 of the holder structure 200. Additionally, the circuit substrate 130 is protected by the first side wall portion 125B and the second side wall portion 126B. The first and the second cartridges 100*a*B and 100*b*B of the third embodiment have similar functions and advantageous effects to those of the first and the second cartridges 100*a* and 100*b* of the first embodiment.

D. Fourth Embodiment

Figure 26:
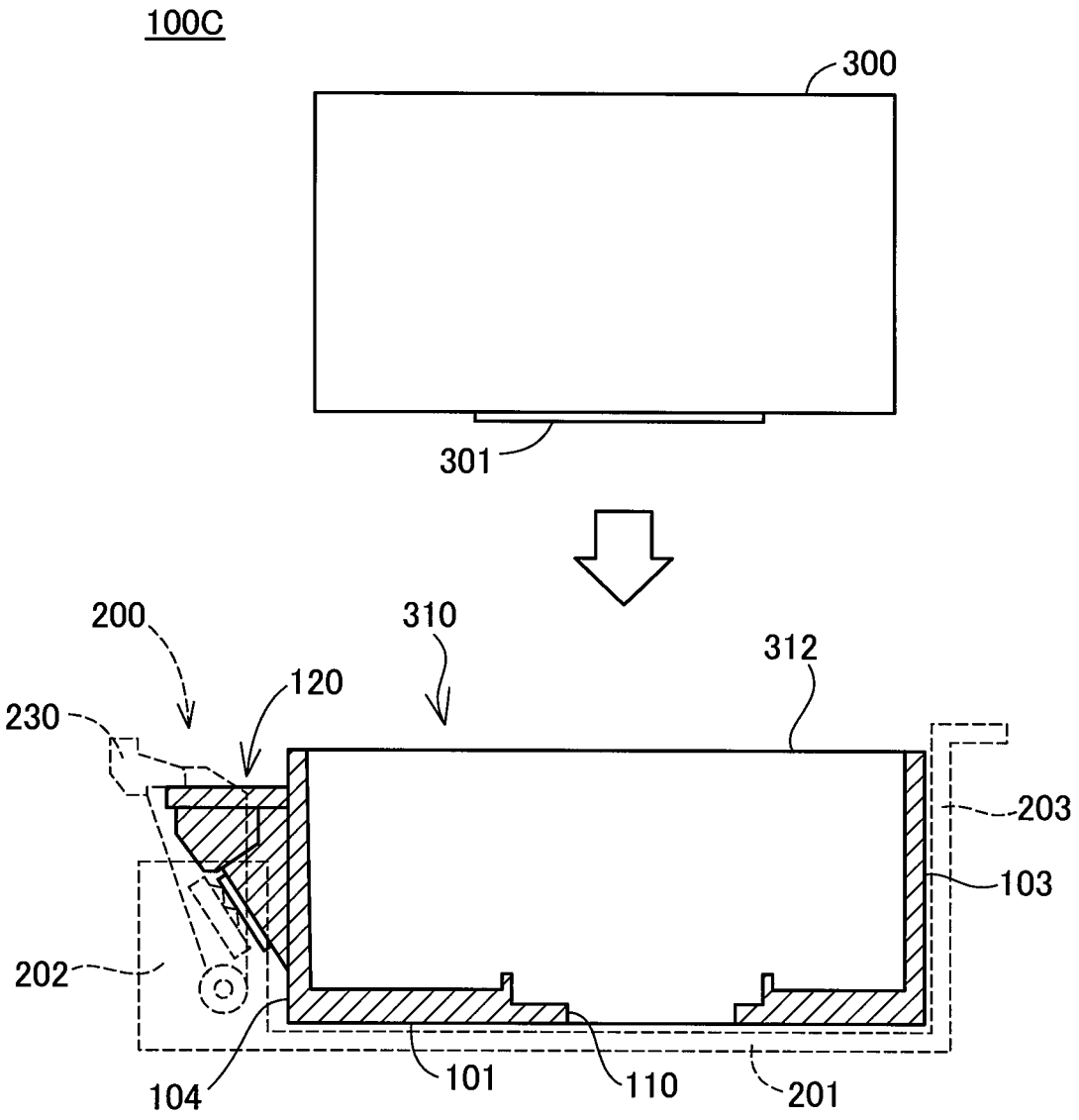
FIG. 26 is a schematic diagram illustrating the configuration of a cartridge according to a fourth embodiment.

FIG. 26 is a schematic diagram illustrating the configuration of a cartridge 100C according to a fourth embodiment of the invention. The like components in FIG. 26 to those described in the first embodiment are expressed by the like numerical symbols. The cartridge 100C of the fourth embodiment is attachable to and detachable from the carriage 27 of the printing device 10 shown in FIG. 2 via the holder structure 200 described in the first embodiment shown in FIGS. 14 to 16. The cartridge 100C of the fourth embodiment has an ink container 300 and an adaptor structure 310. The ink container 300 is provided as a liquid container internally having an ink chamber configured to contain ink. The ink container 300 has an ink outlet port 301 on its lower surface to be connected with an ink supply port 110 of the adaptor structure 310.

The adaptor structure 310 is provided as an exterior vessel configured to receive the ink container 300 through an upper opening 312. The adaptor structure 310 has walls other than the second wall 102 of the first cartridge 100*a* of the first embodiment. In other words, the adaptor structure 310 has walls similar to the first wall 101, the third wall 103, the fourth wall 104, the fifth wall 105 and the sixth wall 106 of the first cartridge 100*a* of the first embodiment. The first or bottom wall 101 of the adaptor structure 310 has an ink supply port 110 similar to that of the first cartridge 100*a* of the first embodiment. A main engagement part 120 and a circuit substrate 130 similar to those described in the first embodiment are disposed on the fourth or front wall 104.

The cartridge 100C of the fourth embodiment causes ink to be supplied to the printing device 10 by attaching the ink container 300 to the holder structure 200 via the adaptor structure 310. In the cartridge 100C of the fourth embodiment, the adaptor structure 310 has first side wall portion 125 and a second side wall portion 126 arranged to press the lever member 230 of the holder structure 200. This enhances the attachment of the cartridge 100C to the printing device 10. The cartridge 100C of the fourth embodiment has similar functions and advantageous effects to those of the first and the second cartridges 100*a* and 100*b* of the first embodiment.

E. Fifth Embodiment

Figure 27:
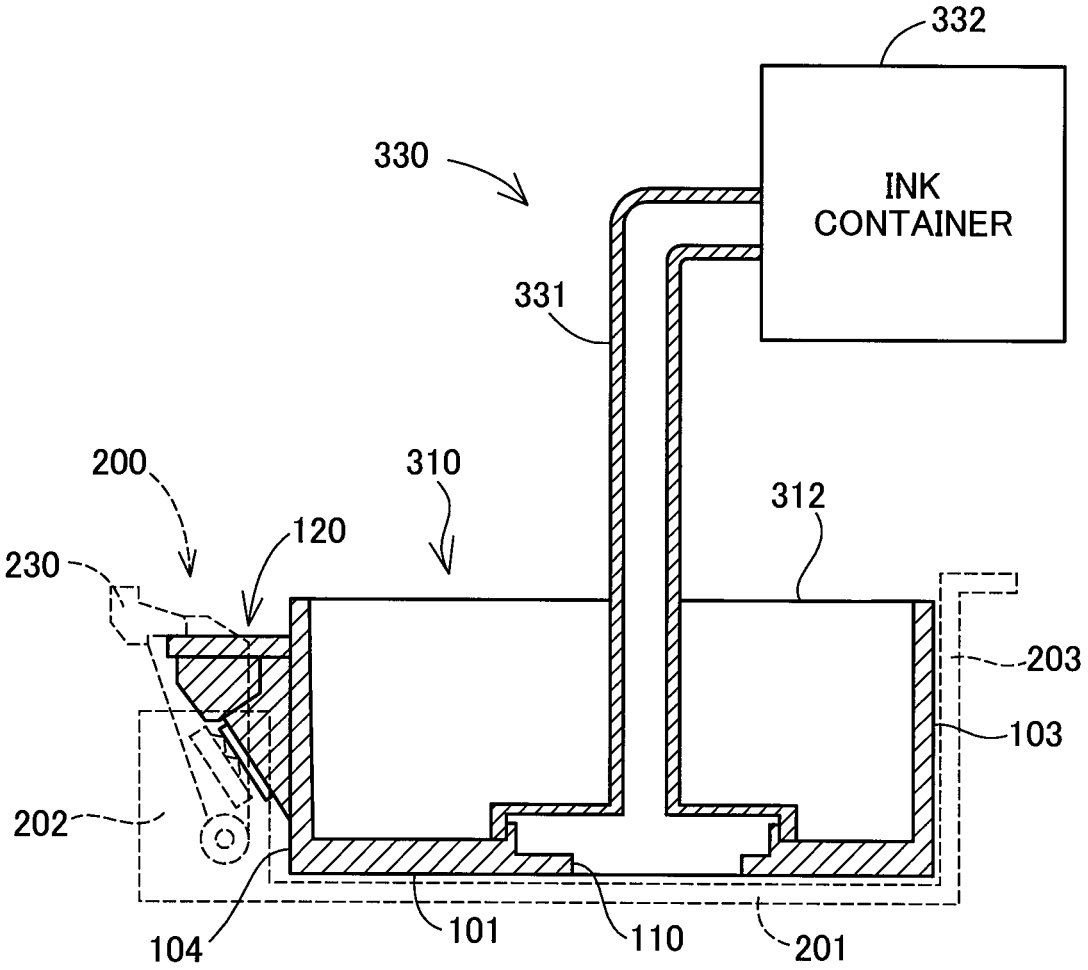
FIG. 27 is a schematic diagram illustrating the configuration of a liquid supply unit according to a fifth embodiment.

FIG. 27 is a schematic diagram illustrating the configuration of a liquid supply unit 330 according to a fifth embodiment of the invention. The like components in FIG. 27 to those described in the first embodiment are expressed by the like numerical symbols. The liquid supply unit 330 of the fifth embodiment is attachable to and detachable from the printing device 10 described in the first embodiment shown in FIGS. 1 and 2 and is attached to supply ink to the carriage 27 of the printing device 10. The liquid supply unit 330 of the fifth embodiment has an adaptor structure 310, an ink supply tube 331 and an ink container 332.

The adaptor structure 310 is similar to the adaptor structure 310 described in the fourth embodiment and has a main engagement part 120 and a circuit substrate 130 on the front or fourth wall 104 and an ink supply port 110 on the bottom or first wall 101. The ink container 332 is a liquid container internally having an ink chamber configured to contain ink. The ink chamber of the ink container 332 is connected with the ink supply port 110 of the adaptor structure 310 via the ink supply tube 331. In the liquid supply unit 330 of the fifth embodiment, the presence of the first side wall portion 125 and the second side wall portion 126 of the main engagement part 120 enhances the attachment of the adaptor structure 310 to the printing device 10. The liquid supply unit 330 of the fifth embodiment has the similar functions and advantageous effects to those of the first and the second cartridges 100*a* and 100*b* of the first embodiment.

F. Modifications

F1. Modification 1

In the first embodiment described above, the first side wall portion 125 and the second side wall portion 126 are provided on both sides of the circuit substrate 130 on the fourth wall 104. The first side wall portion 125 and the second side wall portion 126 may, however, be provided on a wall other than the fourth wall 104 or may be provided at positions other than both sides of the circuit substrate 130. For example, in each of the first and the second cartridges 100*a* and 100*b*, the first side wall portion 125 and the second side wall portion 126 may be provided separately on the fifth wall 105 on the sixth wall 106. In another example, in each of the first and the second cartridges 100*a* and 100*b*, the first side wall portion 125 and the second side wall portion 126 may be provided at the similar positions to those of the first embodiment, while the circuit substrate 130 may be provided on the first wall 101 or the third wall 103. In this modified configuration, the positions of the first terminal 151 and the second terminal 152 on the circuit substrate 130 may be determined independently of the position of the center OC of the ink supply port 110.

F2. Modification 2

Each of the first and the second cartridges 100*a* and 100*b* of the first embodiment has the first side wall portion 125 and the second side wall portion 126 as the first pressure element and the second pressure element to press the lever member 230 of the holder structure 200. In each of the first and the second cartridges 100*a* and 100*b*, however, a first pressure element and a second pressure element to press the lever member 230 of the holder structure 200 may be provided separately from the first side wall portion 125 and the second side wall portion 126. The first pressure element and the second pressure element may be rod-like members protruded from the fourth wall in the direction of the arrow Y. The first pressure element and the second pressure element may not be necessarily provided as protrusions from the wall surface but may be recesses formed in the wall surface. In this modified configuration, the rotating mechanism of the holder structure 200 should have projections that come into contact with the first pressure element and the second pressure element. The first pressure element and the second pressure element may not be necessarily arrayed in the lateral direction (direction of the arrow X) but may be arrayed, for example, at an angle of inclination to the direction of the arrow X. The first pressure element and the second pressure element may be provided at a different wall from the wall where the main engagement part 120 of the holder structure 200 is placed.

F3. Modification 3

In the first embodiment describe above, the first and the second cartridges 100*a* and 100*b* are provided as ink containers in the approximately rectangular parallelepiped shape and are configured to have the six walls 101 to 106. The first and the second cartridges 100*a* and 100*b* may, however, not be in the approximately rectangular parallelepiped shape and may not have all the six walls 101 to 106. Each of the first and the second cartridges 100*a* and 100*b* may be formed, for example, as a hexahedron in an approximately trapezoidal shape viewed in the direction of the arrow X (in the side view) or as an approximately circular disk in an approximately elliptical shape in the side view. Each of the walls 101 to 106 defining the outer shape of each of the first and the second cartridges 100*a* and 100*b* may not have a flat surface or a smooth surface but may have some concavo-convex shape. Each of the walls 101 to 106 may not be extended as a planar surface but may have some cut or crack. Each of the walls 101 to 106 may be bent to have a substantially curved surface. Additionally, the respective walls 101 to 106 may have flexibility and may be provided as a frame to hold a bag-like member containing ink.

F4. Modification 4

In the first embodiment described above, the lever member 230 as the rotating mechanism of the holder structure 200 serves as the engaged part which is to be engaged with the main engagement part 120 of each of the first and the second cartridges 100*a* and 100*b*. The lever member 230 of the holder structure 200 may, however, not serve as the engaged part which is to be engaged with the main engagement part 120 of each of the first and the second cartridges 100*a* and 100*b*. After the lever member 230 is pressed to be rotated and moved by the first side wall portion 125 and the second side wall portion 126, the lever member 230 of the holder structure 200 may not be returned to its initial position but may be kept at the position after the rotating motion in the course of attachment of the first or the second cartridge 100*a* or 100*b*. This modified configuration defines the angle of the first or the second cartridge 100*a* or 100*b* relative to the lever member 230 of the holder structure 200 in the course of attachment.

F5. Modification 5

In the first embodiment described above, the lever member 230 as the rotating mechanism of the holder structure 200 has the two leg sections 231 and the bridging section 232. The lever member 230 may have another structure. For example, the lever member 230 may not have the bridging section 232 but may have two leg sections 231 configured to be rotatable and movable independently of each other. In the first embodiment described above, the lever member 230 of the holder structure 200 is pressed by the pressing mechanism. In this modified configuration, the lever member 230 may be returned to the initial position by the user's finger operation, after being pressed to be rotated and moved by the first side wall portion 125 and the second side wall portion 126.

F6. Modification 6

In the first embodiment described above, in the state that the main engagement part 120 of the first or the second cartridge 100*a* or 100*b* is engaged with the lever member 230, the first side wall portion 125 and the second side wall portion 126 are not in contact with the lever member 230, so as to release the pressing state against the lever member 230. The first side wall portion 125 and the second side wall portion 126 may, however, be in contact with the lever member 230, so as to continue the pressing state against the lever member 230 even in the state that the main engagement part 120 of the first or the second cartridge 100*a* or 100*b* is engaged with the lever member 230. In the description herein, the state of "releasing the pressing state" means the state with substantially no external force applied to an object by pressing and may be the state of keeping in contact with the object.

F7. Modification 7

In the first embodiment described above, the distance WE between the first side wall portion 125 and the second side wall portion 126 in the direction of the arrow X is arranged to be greater than the distance WT between the contact portions CP of the first and the second terminals 151 and 152 in the direction of the arrow X shown in FIG. 22. The distance WE between the first side wall portion 125 and the second side wall portion 126 in the direction of the arrow X may alternatively be arranged to be less than the distance WT between the contact portions CP of the first and the second terminals 151 and 152 in the direction of the arrow X F8. Modification 8

In the first embodiment described above, the extended section 113 from the cover member constituting the second wall 102 is extended to the rear face side of the main engagement part 120 and forms part of the main engagement part 120. The extended section 113 may be integrated with the main engagement part 120 to form the first side wall portion 125 and the second side wall portion 126.

F9. Modification 9

In the first embodiment described above, the first and the second terminals 151 and 152 are used for detection of the state of attachment of the first and the second cartridges

100*a* and 100*b* to the holder structure 200. The first and the second terminals 151 and 152 may, however, be used for a different purpose other than detection of the state of attachment of the first and the second cartridges 100*a* and 100*b*. For example, each of the first and the second terminals 151 and 152 may be used as a power terminal or as a ground terminal or may be used for communication of data signals. In the circuit substrate 130 of the above first embodiment, the terminals 153 to 159, i.e., the terminals other than the first and the second terminals 151 and 152, may be omitted. Even in such modification, the first and the second terminals 151 and 152 may also be used for the purpose other than detection of the state of attachment of the first and the second cartridges 100*a* and 100*b*.

F10. Modification 10

In the first embodiment described above, each of the first and the second cartridges 100*a* and 100*b* is attached to the holder structure 200 along the locus of rotating motion about the upper edge of the third wall 103 as the supporting point shown in FIGS. 19 and 20. Each of the first and the second cartridges 100*a* and 100*b* may, however, not be attached to the holder structure 200 along the locus of rotating motion about the upper edge of the third wall 103 as the supporting point. For example, each of the first and the second cartridges 100*a* and 100*b* may be attached to the holder structure 200 downward along the linear locus.

F11. Modification 11

In the first embodiment described above, the ink supply port 110 of the first cartridge 100*a* and the ink supply ports 110*a* to 110*c* of the second cartridge 100*b* are provided on the first wall 101, which is opposed to the bottom wall 201 of the holder structure 200 on which the first and the second cartridges 100*a* and 100*b* are placed. The ink supply port 110 and the ink supply ports 110*a* to 110*c* may, however, be provided on another wall. The ink supply port 110 and the ink supply ports 110*a* to 110*c* should be formed at the positions such that the distance between the ink supply port 110 or 110*a* and the first side wall portion 125 or the second side wall portion 126 in the supply port connecting direction is longer than the distance between the ink supply port 110 or 110*a* and the rotation axis RX of the lever member 230 in the supply port connecting direction at least in the course of attachment of the first and the second cartridges 100*a* and 100*b* to the holder structure 200.

F12. Modification 12

In the first embodiment described above, each of the first and the second cartridges 100*a* and 100*b* has the circuit substrate 130 which is electrically connected with the printing device 10. The circuit substrate 130 is, however, not essential in the first and the second cartridges 100*a* and 100*b* but may be omitted.

F13. Modification 13

In the first embodiment described above, the first and the second cartridges 100*a* and 100*b* are attached to the printing device 10. A single cartridge produced by integrating the first and the second cartridges 100*a* and 100*b* may be attached to the printing device 10. A plurality of cartridges, each having a single ink chamber, like the first cartridge 100*a*, may be attached to the printing device 10. A plurality of cartridges, each having a plurality of ink chambers, like the second cartridge 100*b*, may be attached to the printing device 10.

F14. Modification 14

In the circuit substrate 130 of the first and the second cartridges 100*a* and 100*b* of the first embodiment described above, the contact portions CP of the plurality of terminals 151 to 159 are divided into two lines, i.e., upper line and lower line and are arrayed in the array direction parallel to the direction of the arrow X. In the circuit substrate 130, however, it is not essential that all the contact portions CP of the respective terminals 151 to 159 are arrayed in the specific array direction. In the circuit substrate 130, it is only required that the contact portions CP of at least the first and the second terminals 151 and 152 out of the contact portions CP of the respective terminals 151 to 159 should be arrayed in one specific array direction. In this modification, the specific array direction is not necessarily the direction parallel to the direction of the arrow X but may be a direction inclined to the direction of the arrow X. In the first embodiment described above, the respective terminals 151 to 159 have similar array configuration to the array configuration of their respective contact portions CP. The respective terminals 151 to 159 may, however, not have similar array configuration to the array configuration of their respective contact portions CP. For example, while the respective adjacent contact portions CP may be arrayed linearly, the respective adjacent terminals 151 to 159 may be offset vertically to be arranged in zigzag. In the first embodiment described above, the contact portion CP is provided at the substantially middle position in each of the terminals 151 to 159. The contact portion CP of each of the terminals 151 to 159 may, however, be provided at a different position, for example, a position near to some side or a position near to some corner, in each of the terminals 151 to 159. The respective terminals 151 to 159 are not limited to the approximately rectangular shape but may be in any of various other shapes.

F15. Modification 15

The above respective embodiments and modifications describe the ink supply units such as the first and the second cartridges 100*a* and 100*b* attached to the printing device 10 having the liquid ejection mechanism of ejecting ink, as the liquid supply units of the invention. The liquid supply unit of the invention may be configured as a supply unit of a different liquid other than ink. For example, the liquid supply unit of the invention may be configured as a water supply unit attached to a high-pressure cleaning machine which sprays a liquid such as water onto an object to be cleaned and cleans the object, to supply water.

F16. Modification 16

As described in the above first embodiment, the first and the second terminals 151 and 152 have the similar functions to those of the fifth and the sixth terminals 155 and 156. Accordingly, the description regarding the relationship between the first and the second terminals 151 and 152 and another component of the first or the second cartridge 100*a* or 100*b* or another component of the holder structure 200 in the above respective embodiments and modifications can be interpreted with replacement of the first and the second terminals 151 and 152 with the fifth and the sixth terminals 155 and 156. More specifically, such description may be interpreted on the assumption that the fifth terminal 155 and the sixth terminal 156 respectively correspond to the first detection terminal having the first contact portion and the second detection terminal having the second contact portion. This modified configuration provides the functions and advantageous effects similar to those described in the first embodiment.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

The invention claimed is:

1. A liquid supply unit attachable to a liquid ejection device having an electrode assembly, a liquid introduction conduit and a rotating mechanism including a first pressed part and a second pressed part, the liquid supply unit comprising:

a first wall having a liquid supply port configured to supply a liquid into the liquid introduction conduit;

a second wall opposite to the first wall in a Z-direction;

a third wall intersecting with the first and the second wall;

a fourth wall opposite to the third wall and intersecting with the first and the second wall in a Y-direction perpendicular to the Z-direction, the fourth wall having an upper edge near the intersection of the fourth wall and the second wall and a lower edge near the intersection of the fourth wall and the first wall;

an inclined surface extending outward in the Y-direction and upward in the Z-direction from the fourth wall;

an array of contact portions adapted to be electrically connectable with the electrode assembly, the contact portions provided on the inclined surface; and a first side wall portion and a second side wall portion extending from the fourth wall in a Y-direction, positioned with the inclined surface located therebetween in a plan view of the liquid supply unit in a direction from the fourth wall toward the third wall, wherein the inclined surface has an upper edge, which is located at a position closer to the upper side of the fourth wall than to the lower edge of the fourth wall.

2. The liquid supply unit according to claim 1, wherein:

the first side wall and the second side wall are extended more outwardly from the fourth wall than the inclined surface.

3. The liquid supply unit according to claim 1, wherein the inclined surface comprises an exposed surface of a circuit substrate.

4. The liquid supply unit according to claim 1, wherein an engagement ledge extends outward from the fourth wall, in the Y-direction, above the inclined surface and closer to the upper edge of the fourth wall than the inclined surface, the engagement ledge having a first brim section over the first side wall and a second brim section over the second side wall, the engagement ledge adapted to engage the rotating mechanism in the state wherein the liquid supply unit has been attached to the liquid ejection device.

5. The liquid supply unit according to claim 4, wherein the first side wall portion, the second side wall portion and the engagement ledge extend farther outward from the fourth wall, in the Y-direction, than does the inclined surface.

6. The liquid supply unit according to claim 5, wherein the first side wall portion extends downwards from the first brim section and the second side wall portion extends downwards from the second brim section and the first and second side wall portions are adapted and positioned to engage the first and second pressed parts of the rotating mechanism while the liquid supply unit is being attached to the liquid ejection device.

7. The liquid supply unit according to claim 6, wherein the engagement ledge, the first side wall portion and the second side wall portion form a recess and the inclined surface is located at least partially within the recess.

8. The liquid supply unit according to claim 4, wherein the first side wall portion extends downwards from the first brim section and the second side wall portion extends downwards from the second brim section and the engagement ledge, the first side wall portion and the second side wall portion form a recess and the inclined surface is located at least partially within the recess.

9. The liquid supply unit according to claim 1, wherein the first side wall and the second side wall engage the first and second pressed parts of the rotating mechanism during attachment of the liquid supply unit to the liquid ejection device.

10. A liquid supply unit attachable to a liquid ejection device having an electrode assembly, a liquid introduction conduit and a rotating mechanism including a first pressed part and a second pressed part, the liquid supply unit comprising:

a first wall having a liquid supply port configured to supply a liquid into the liquid introduction conduit;

a second wall opposite to the first wall in a Z-direction;

a third wall intersecting with the first wall and the second wall;

a fourth wall opposite to the third wall and intersecting with the first wall and the second wall in a Y-direction perpendicular to the Z-direction;

an inclined surface extending outward in the Y-direction and upward in the Z-direction from the fourth wall;

an array of contact portions adapted to be electrically connectable with the electrode assembly, the contact portions provided on the inclined surface; and a first side wall portion and a second side wall portion extending from the fourth wall in the Y-direction, positioned with the inclined surface located therebetween in a plan view of the liquid supply unit in a direction from the fourth wall toward the third wall, and further comprising an abutting part configured to come into contact with the rotating mechanism when the liquid supply unit is attached to the liquid ejection device, the abutting part located on an upper portion of the inclined surface in a plan view of the liquid supply unit in a direction from the fourth wall toward the third wall.

11. The liquid supply unit according to claim 10, wherein the abutting part is formed by an extended section extending outward from the fourth wall.

12. The liquid supply unit according to claim 11, wherein the extended section protrudes more from the fourth wall than does the upper side of the inclined surface.

* * * * *